US007578561B2

(12) United States Patent
Canna et al.

(10) Patent No.: US 7,578,561 B2
(45) Date of Patent: Aug. 25, 2009

(54) CHILD SEAT WITH REMOVABLE RESTRAINT SYSTEM

(75) Inventors: John S. Canna, Orchard Park, NY (US); Brian S. Kelly, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/678,888

(22) Filed: Feb. 26, 2007

(65) Prior Publication Data

US 2007/0200404 A1 Aug. 30, 2007

Related U.S. Application Data

(60) Provisional application No. 60/776,930, filed on Feb. 28, 2006.

(51) Int. Cl.
*A62B 35/00* (2006.01)

(52) U.S. Cl. ..... 297/485; 297/250.01; 297/468; 297/484

(58) Field of Classification Search ..... 297/250.1, 297/468, 469, 473, 483, 484, 485; 24/579.11, 24/612, 613, DIG. 35
See application file for complete search history.

(56) References Cited

U.S. PATENT DOCUMENTS 1,363,291 A * 12/1920 Thompson ..... 24/657
2,252,357 A 8/1941 Shaw
2,404,108 A 7/1946 Stauffacher et al.
2,498,471 A 2/1950 Williams
2,557,084 A 6/1951 Edmondson
2,741,412 A 4/1956 Hinkle
2,848,040 A 8/1958 Chernivsky
3,034,596 A 5/1962 Twaits, Jr.
3,136,581 A 6/1964 Caballero
3,542,426 A 11/1970 Radke
3,713,692 A 1/1973 McCracken et al.
3,825,979 A * 7/1974 Jakob ..... 24/579.11
3,831,225 A 8/1974 Bengtsson
4,235,474 A 11/1980 Rosenberg
4,438,552 A 3/1984 Omata
4,612,687 A 9/1986 Barwood
4,675,955 A * 6/1987 Nakamura ..... 24/656
4,795,216 A 1/1989 Culver et al.
4,861,109 A 8/1989 Leach
4,867,464 A 9/1989 Cook
5,082,325 A * 1/1992 Sedlack ..... 297/468
D362,971 S 10/1995 Pacheco (Continued)

FOREIGN PATENT DOCUMENTS

GB 2367738 A 4/2002

OTHER PUBLICATIONS

Mobility Solutions from Columbia Medical, 2 pages, www.columbiamedical.com, Jan. 2003.

*Primary Examiner*—Peter R Brown
*Assistant Examiner*—Patrick Lynch
(74) *Attorney, Agent, or Firm*—Edell, Shapiro & Finnan, LLC

(57) ABSTRACT

The present invention discloses a child seat comprised of a seat structure and a child restraint system that allows a restraint to be easily removed from the seat structure and cleaned separately and away from the child seat. The restraint system includes a restraint and a restraint release mechanism.

14 Claims, 25 Drawing Sheets

U.S. PATENT DOCUMENTS 5,582,462 A 12/1996 Shea
5,676,426 A 10/1997 Herring
5,927,235 A 7/1999 Olaiz
6,095,614 A * 8/2000 Canna et al. ..... 297/468
6,305,745 B1 * 10/2001 Rijsdijk ..... 297/250.1
6,330,736 B1 * 12/2001 Cheng ..... 24/656
6,398,302 B1 * 6/2002 Freedman et al. ..... 297/250.1
6,409,272 B1 6/2002 Martin et al.
6,543,101 B2 4/2003 Sack et al.
6,543,847 B2 * 4/2003 Balensiefer ..... 297/250.1
6,695,412 B2 * 2/2004 Barger et al. ..... 297/484
6,698,841 B1 * 3/2004 Glover et al. ..... 297/484
6,711,790 B2 3/2004 Pontaoe
6,799,807 B1 * 10/2004 Chen ..... 297/484
6,820,939 B1 * 11/2004 Chen ..... 297/484
2002/0195867 A1 * 12/2002 Barger et al. ..... 297/484
2003/0193225 A1 * 10/2003 Kain ..... 297/250.1
2006/0214495 A1 * 9/2006 Glover et al. ..... 297/484

* cited by examiner

CHILD SEAT WITH REMOVABLE RESTRAINT SYSTEM

CROSS-REFERENCE TO RELATED APPLICATIONS

This application claims priority to U.S. Provisional Patent Application Ser. No. 60/776,930, entitled "Child Seat with Removable Restraint System" and filed Feb. 28, 2006. The disclosure of the above-mentioned provisional application is incorporated herein by reference in its entirety.

BACKGROUND OF THE INVENTION

The present invention relates to a support structure for a child, and more particularly to a support structure for a child with a removable restraint system.

Conventional child support structures, such as a highchair are typically used to support young children during feeding and other seated activities. The use of a highchair allows a child to be safely and comfortably positioned at a higher elevation than if the child were placed in a conventional adult seat. This higher, secure, positioning gives parents easier access to the child during activities such as feeding.

Feeding a young child can be a very messy process. This is especially true if parents are attempting to train a child to be more independent by allowing them more freedom to feed themselves. A child with food covering them and covering their clothes can be removed from a conventional highchair, given a bath and a change of clothes. However, generally, food also covers various child accessible portions of the highchair.

In particular, most highchair child seats include a child restraint system. The restraint system generally includes restraint straps and some sort of fastening members (buckles, etc.) for fastening the restraint straps to together. The close proximity of the restraint straps and fastening members to the child seated in the highchair makes them a primary target for both dropped food and the child's messy hands and thus, the restraint system is almost always soiled when the highchair is in use. Straps and buckles, designed primarily for restraint (safety) and not for ease of cleaning, generally have many nooks and crannies that give food and other messy substances a place to hide. As a result, the restraint system of the support structure for a child and other parts of the support structure cannot be easily cleaned and after baby receives a bath and clean clothes, a parent must often place baby in the same seat with a previously soiled restraint system.

A need therefore exists for a child seat structure that can be easily cleaned in spite of having a type fastener restraint system located within reach of the child and food deposits.

SUMMARY OF THE INVENTION

The present invention discloses a highchair with a restraint system that is both easy to remove from the child support device and is easy to clean. The ease of cleaning is greatly facilitated by providing a restraint system that can be easily removed from the child support device and cleaned separately and away from the child support device (e.g., in the kitchen sink or a dishwasher). The structure of the child support device of the present invention is illustrated herein as an easy-to-clean high chair that includes a seat portion and a restraint portion that is removable from the seat portion.

The seat portion of the child support device of the present invention has a child receiving side on which the child sits and an outer side opposite the child receiving side. While seated, the child has access to the child receiving side and does not have access to the outer side of the seat portion. The seat portion also includes a back rest portion and a seating portion. The back rest portion supports a child's back and the seating portion supports a child's bottom when the child is seated on the child support device.

The child support device of the present invention also includes a restraint system connected to the seat portion of the child support device. The restraint system of the child support device of the present invention is comprised of at least two straps. Each restraint strap passes through passages in the seat portion of the child support device so that one end of the straps extends to the child receiving side and the other end extends to the outer side (the side that is not accessible to the seated child). On the child receiving side of the seat portion, one end of one of the straps is releasably connected to another end of another one of the straps. The other end of each strap is releasably connected to a restraint release mechanism on the outer side of the seat portion (again, that is not accessible by the seated child). A child restrained in the seat portion can be released by disconnecting the restraint strap ends disposed on the child receiving side of the seat portion or by utilizing the restraint release mechanism on the outer side of the seat portion. The restraint release mechanism of the child support device of the present invention can be any type of connector that can securely restrain the ends of multiple restraint straps and selectively release at least one of the straps or simultaneously release all of the straps quickly and easily.

The restraint system of the child support device of the present invention is easily removed from the seat portion by actuating the restraint release mechanism to release the ends of the straps that extend to the outer side of the seat portion (the side of the seat that is not accessible to the child). The straps can then be pulled, from the child receiving side, through the passages in the seat portions and the restraint system can be taken away from the child support device to a convenient location to be cleaned. Food and dirt can then be more easily and thoroughly removed from hard to reach areas of the restraint system of the present invention.

BRIEF DESCRIPTION OF THE DRAWINGS

Like reference numerals have been used to identify like elements throughout this disclosure.

DETAILED DESCRIPTION OF THE INVENTION

In accordance with the present invention, a child support device is disclosed. The child support device includes a seat, a tray supported by the seat and a support frame that supports the seat above a supporting surface. The child support device includes a seat with a child receiving side and an outer side opposite the child receiving side. The seat also includes a restraint system for restraining a child sitting in the seat. The restraint system includes restraints and a restraint release mechanism. The restraints include a plurality of straps passable through passages in the seat from the child receiving side to the outer side of the seat. The restraint release mechanism releasably secures ends of the straps to the outer side of the seat. In other words, the restraints are secured to the seat by passing strap ends through passages in the seat from the child receiving side to the outer side and then securing the strap ends of the restraints to the restraint release mechanism. When a parent desires to remove the entire set of restraints from the seat, a single actuation of the restraint release mechanism frees the strap ends and thereby releases the restraints. The restraints can then be pulled back through the passages in the seat from the outer side to the child receiving side and taken to a convenient place for cleaning (e.g., the kitchen sink, dishwasher, etc.).

Figure 1:
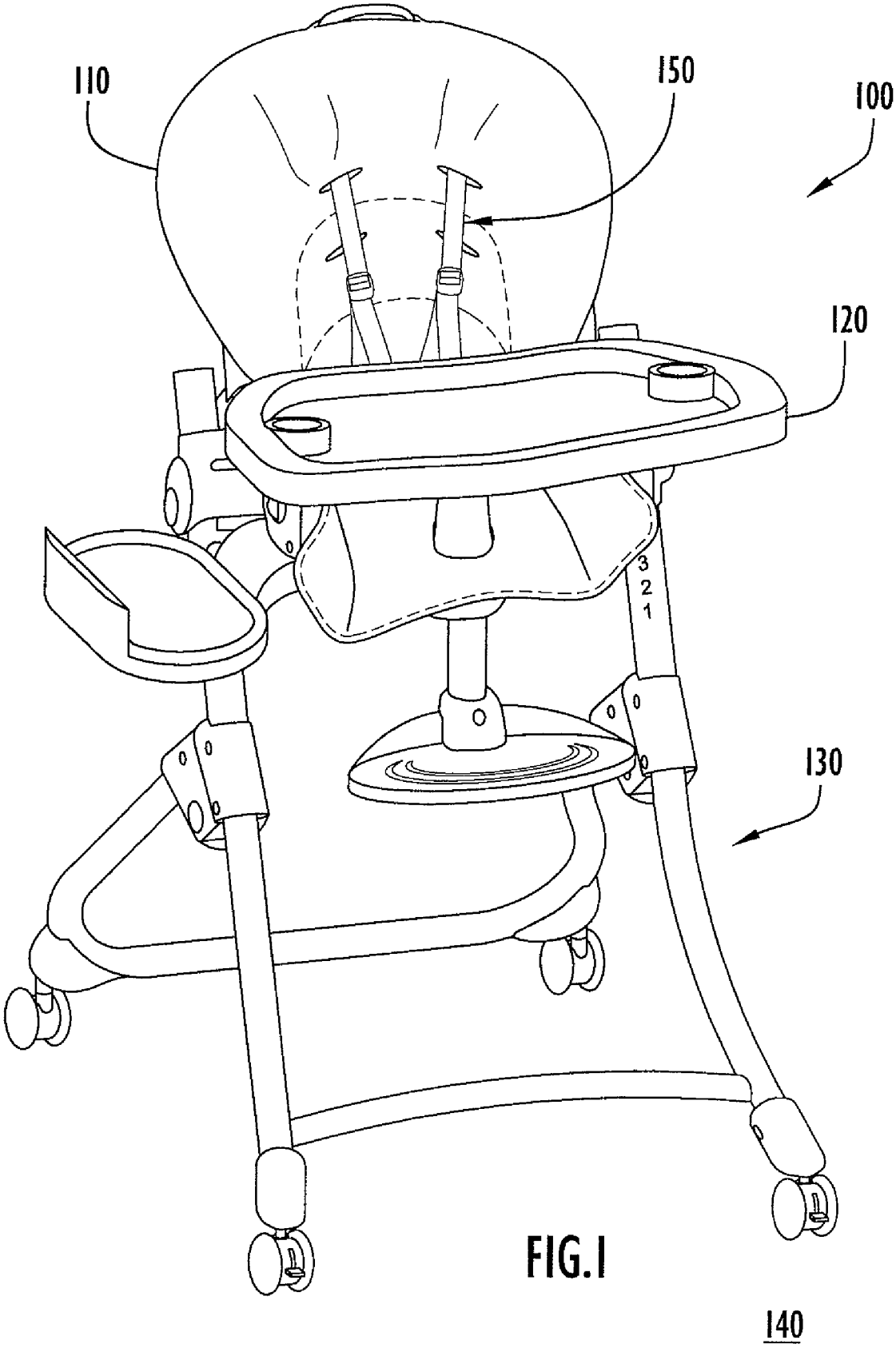
FIG. 1 illustrates a perspective view of a child support device in accordance with the present invention standing on a supporting surface and including a dining tray.

FIG. 1 illustrates a perspective view of the child support device 100 of the present invention standing on a supporting surface 140 and including a seat portion 110 supporting a tray 120. The seat or seat portion 110 and the tray 120 are supported above the supporting surface 140 by a support frame 130. FIG. 1 also shows restraints 150 for securing a child to the seat 110. The restraints 150 are a portion of a child restraint system that includes the restraints 150 and a restraint release mechanism (shown in FIGS. 12-23 and discussed more thoroughly below). The child support device 100 of the present invention is composed of various component parts that are designed and constructed for easy initial assembly and for easy adjustability during use.

Figure 2A:
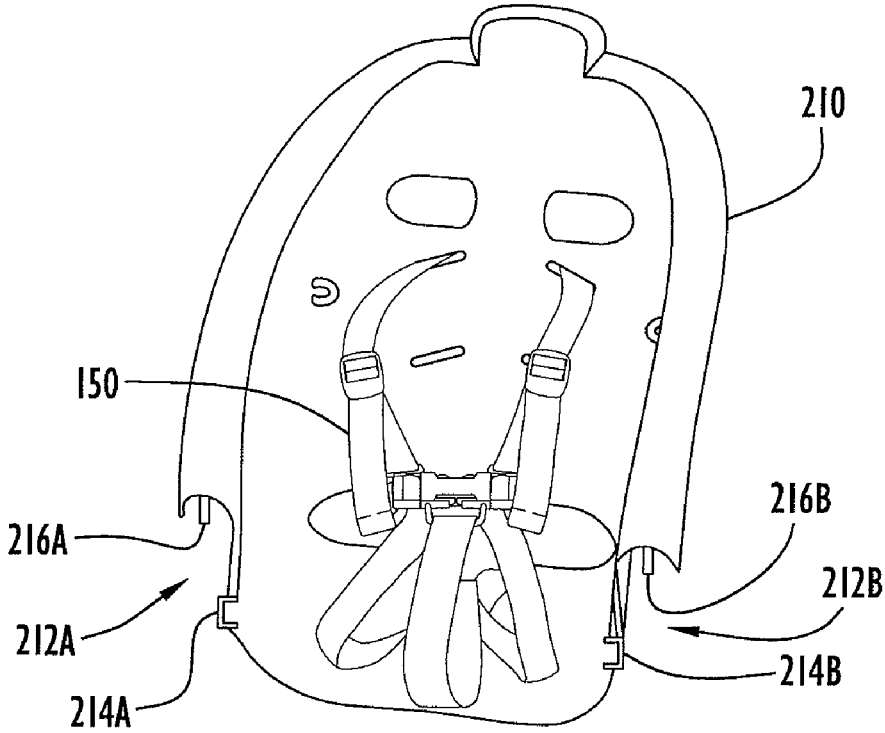
FIG. 2A illustrates a perspective view of a back rest portion of the seat of the child support device in accordance with the present invention.

FIG. 2A illustrates a front perspective view of the child receiving side of a back rest portion 210 of the seat 110 of the present invention. On each side A and B of the lower portion of the back rest portion 210 are lower seat connection areas 212A and 212B respectively. Each lower seat connection area 212A and 212B includes pivot members 214A and 214B respectively and locking projection members 216A and 216B respectively. The restraints 150 are also shown with portions thereof passing through the seat 110.

Figure 2B:
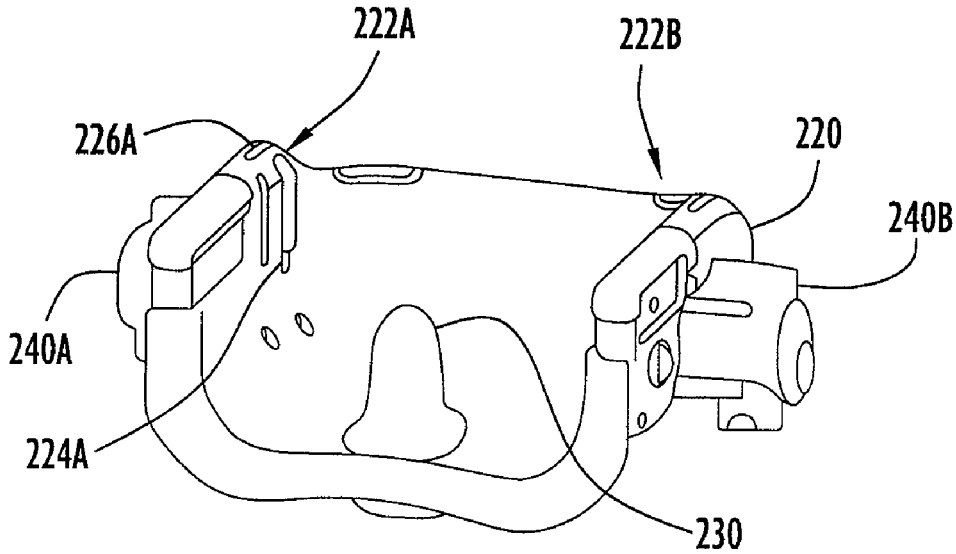
FIG. 2B illustrates a perspective view of a seating portion of the seat of the child support device in accordance with the present invention.

FIG. 2B illustrates a front perspective view of a seating portion 220 of the seat 110 of the child support device 100 of the present invention. On each side A and B of the upper portion of the seating portion 220 are upper seat connection areas 222A and 222B. Each upper seat connection area 222A and 222B includes pivot members 224A and 224B (not labeled) respectively and locking reception members 226A and 226B (not labeled) respectively. The seating portion 220 also includes a crotch post 230 for further securing the child in the seat 110. Finally, each side of the seating portion 220 has a slide lock connector 240A and 240B (discussed further below).

Figure 3:
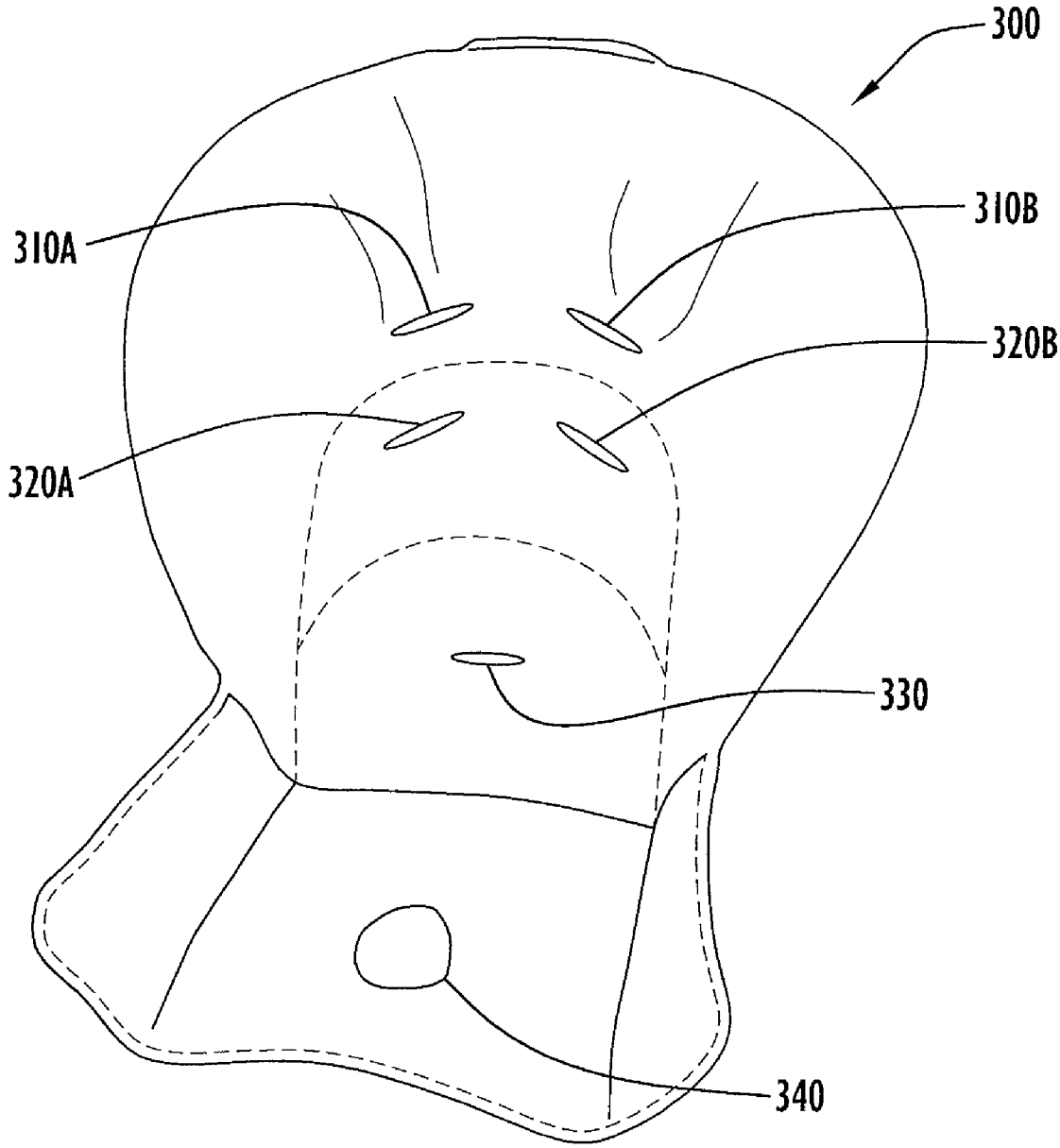
FIG. 3 illustrates a perspective view of a cushioned seat pad for use with the child support device in accordance with the present invention, the seat pad including passages corresponding to the back rest portion of the seat.

FIG. 3 illustrates a perspective view of a seat pad 300 of the present invention for cushioning the seat 110. The seat pad 300 is made from any type of soft, durable, cushion material that is safe and comfortable to a child's touch. The seat pad 300 shows upper shoulder restraint passages 310A and 310B, lower shoulder restraint passages 320A and 320B, a crotch restraint strap passage 330 and a crotch post passage 340. Each passage 310A, 310B, 320A, 320B, 330 and 340 is associated with a corresponding feature of the seat 110 of the present invention.

Figure 4:
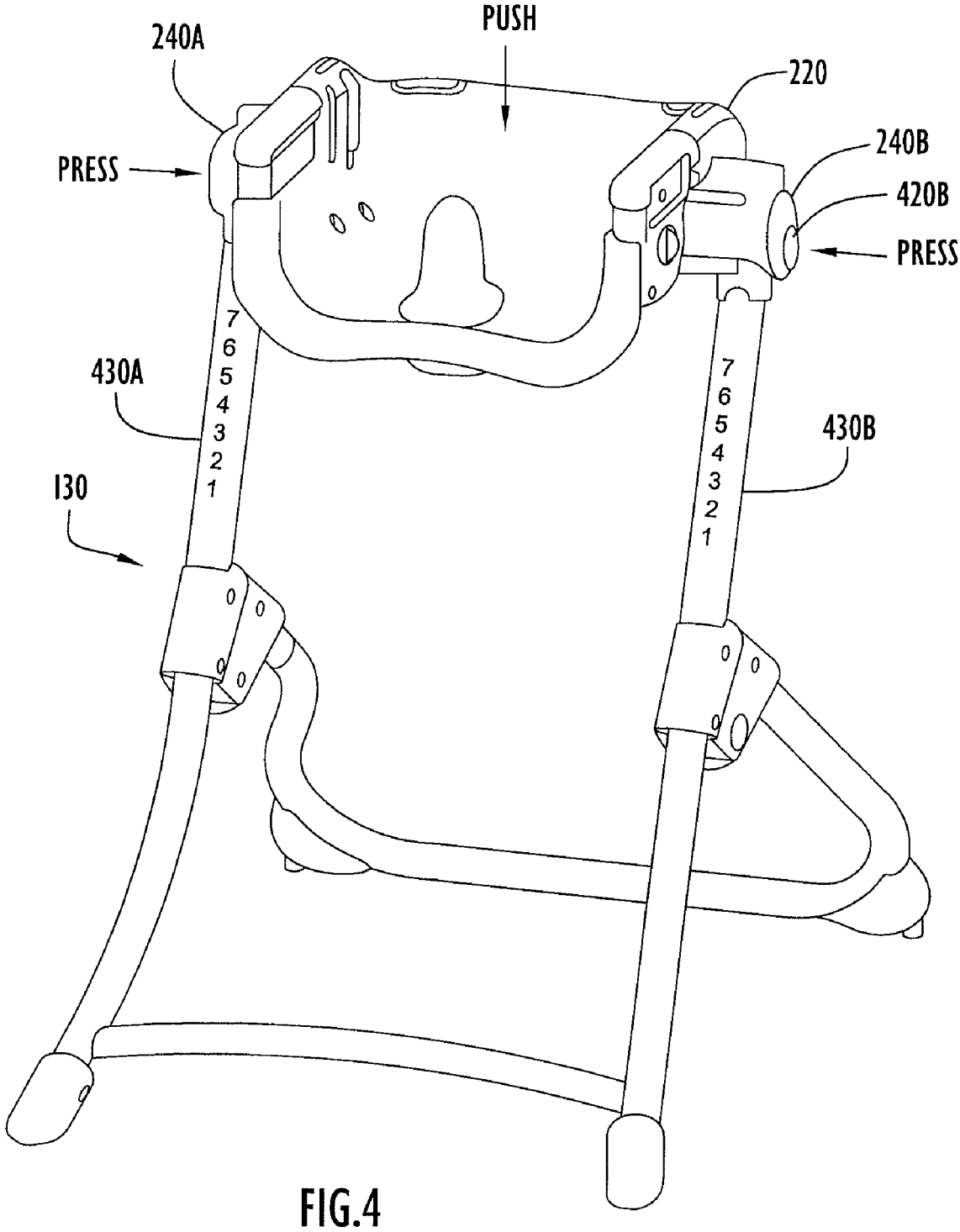
FIG. 4 illustrates a perspective view of the seating portion of the seat of the child support device in accordance with of the present invention, the seating portion being connected to the supporting frame of a child support device in accordance with the present invention.

FIG. 4 illustrates a perspective view of the seating portion 220 of the child support device 100 of the present invention connecting to the supporting frame 130. Each side of the supporting frame 130 includes a post 430A and 430B. The seating portion 220 is connected to the supporting frame 130 by inserting the appropriate post 430A or 430B into the corresponding slide lock connector 240A or 240B. Each post 430A and 430B has a series of openings (not shown) along the length of the posts. Each slide lock connector 240A and 240B has a retractable extension (not shown) and a depressible button 420A (not labeled) and 420B. Pressing the depressible button 420A and 420B causes the retractable extension (not shown) to retract. When the depressible button 420A and 420B is pressed and the retractable extension (not shown) is retracted, the slide lock connector 240A and 240B can slide up and down the post 430A and 430B to adjust to various heights (thus the overall height of the child support device 100 is fully adjustable). When the depressible buttons 420A and 420B are released, each of their retractable extensions project into one of the openings (not shown) to lock the position of each slide lock connector 240A and 240B along the post 430A or 430B.

Figure 5:
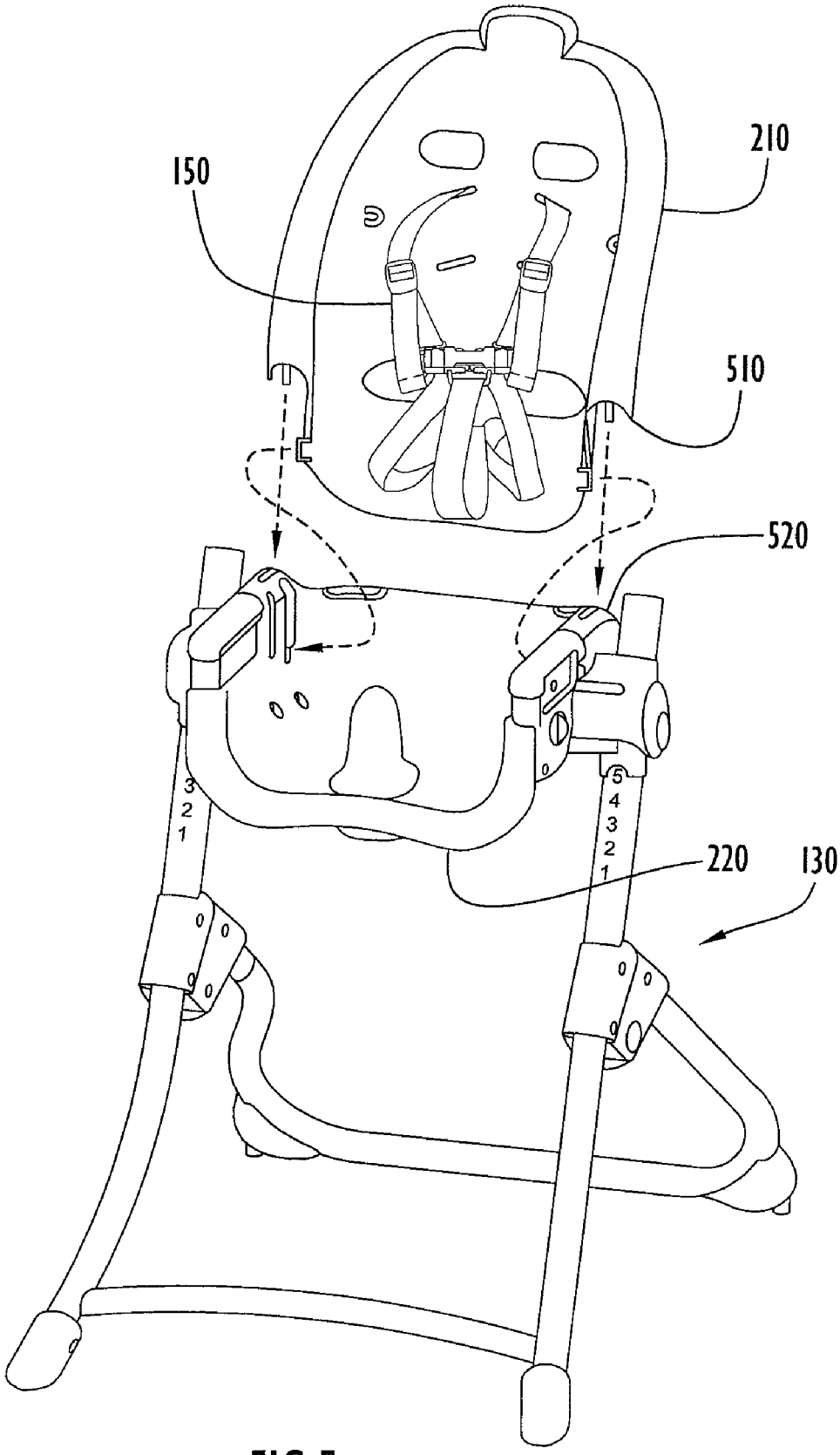
FIG. 5 illustrates a perspective view of the back rest portion of a child support device in accordance with the present invention, the back rest portion being connected to the seating portion of a child support device in accordance with the present invention.

FIG. 5 illustrates a front perspective view of the back rest portion 210 of the child support device 100 of the present invention being connected to the seating portion 220 of the child support device 100. The back rest portion 210 pivotally interconnects with the seating portion 220 to provide for multiple back rest recline positions. The back rest portion 210 has pivot members 214A and 214B that, respectively, cooperate with pivot member 224A and 224B of the seating member 220. Each side A and B has a pin member (not shown) that passes through the pivot members (e.g., through 214A and 224A on side A) to allow the pivot members 214A (with 224A) and 214B (with 224B), and thus, the back rest portion 210 and seating portion 220 to pivot relative to each other. At each recline position of the back rest portion 210, the locking projection members 216A and 216B mate with separate locking reception members 226A and 226B to secure the back rest portion 210 at various angles relative to the seating portion 220. Thus to assemble the child support device 100 of the present invention, the back rest portion 210 is moved from position 510 to position 520 (into contact with the seating portion 220.

Figure 6:
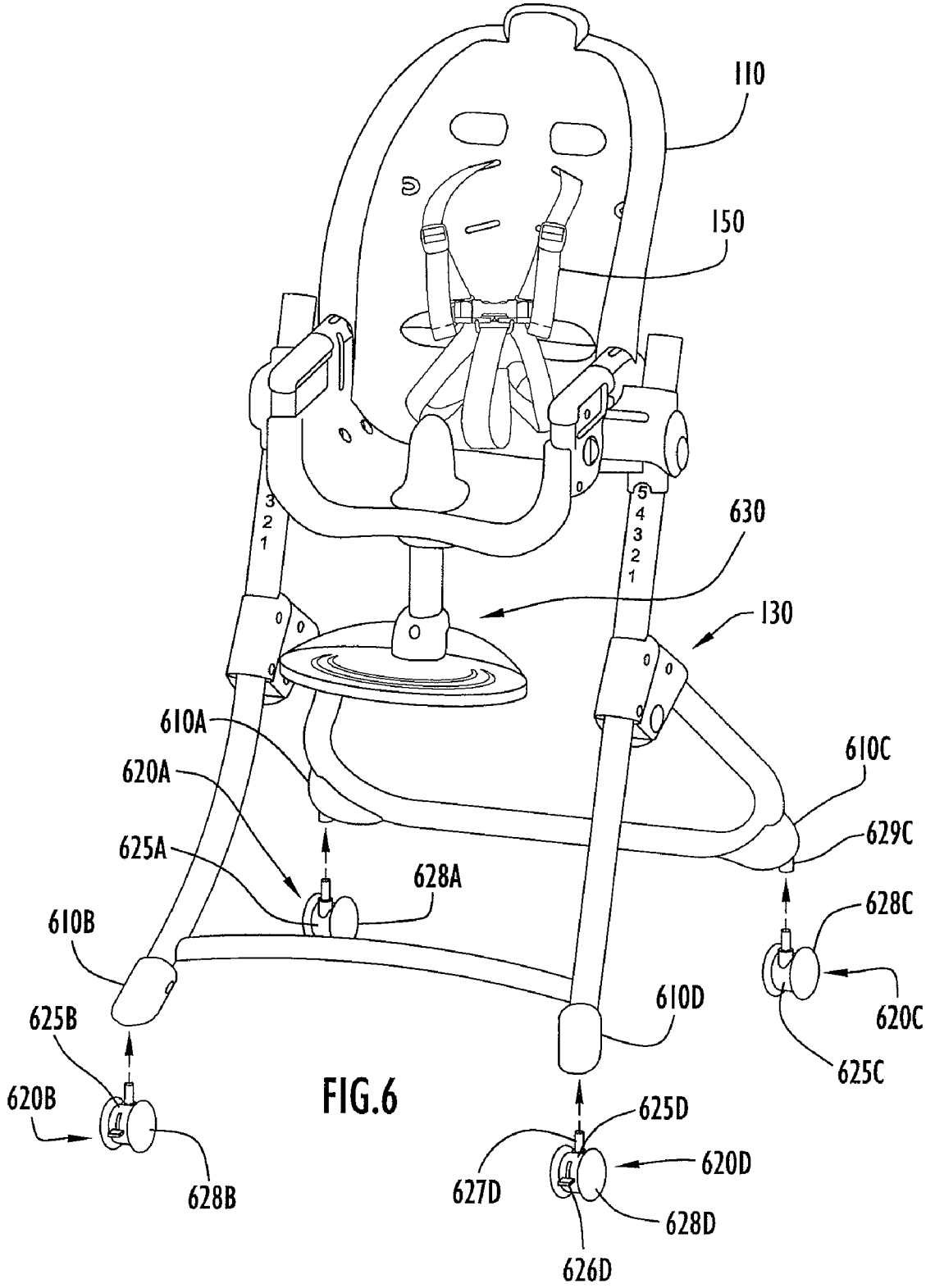
FIG. 6 illustrates a perspective view of a support frame for a child support device in accordance with the present invention including foot members with removable wheels connected to the foot members.

FIG. 6 illustrates a front perspective view of a seat 110 with the restraints 150 and a child foot rest 630. Supporting the seat 110 is a seat support frame 130 including foot members 610A-D with removable casters 620A-D connected to the respective foot members 610A-D. Each of the casters 620A-D includes central hubs 625A-D between two wheels 628A-D. The central hubs 625A-D each includes an extension post (illustrated at 627D) that is lockably and swivelably received in reception members (illustrated at 629D) of their respective foot members 610A-D. Each of the casters 620A-D also has locking members (illustrated at 626D) that lock the wheels 628A-D relative to the central hub 625A-D. Therefore, activating the locking members 626A-D, prevents the wheels 628A-D from moving relative to the central hubs 625A-D, and consequently, prevents the child support device 100 from moving relative to the supporting surface 140.

Figure 7A:
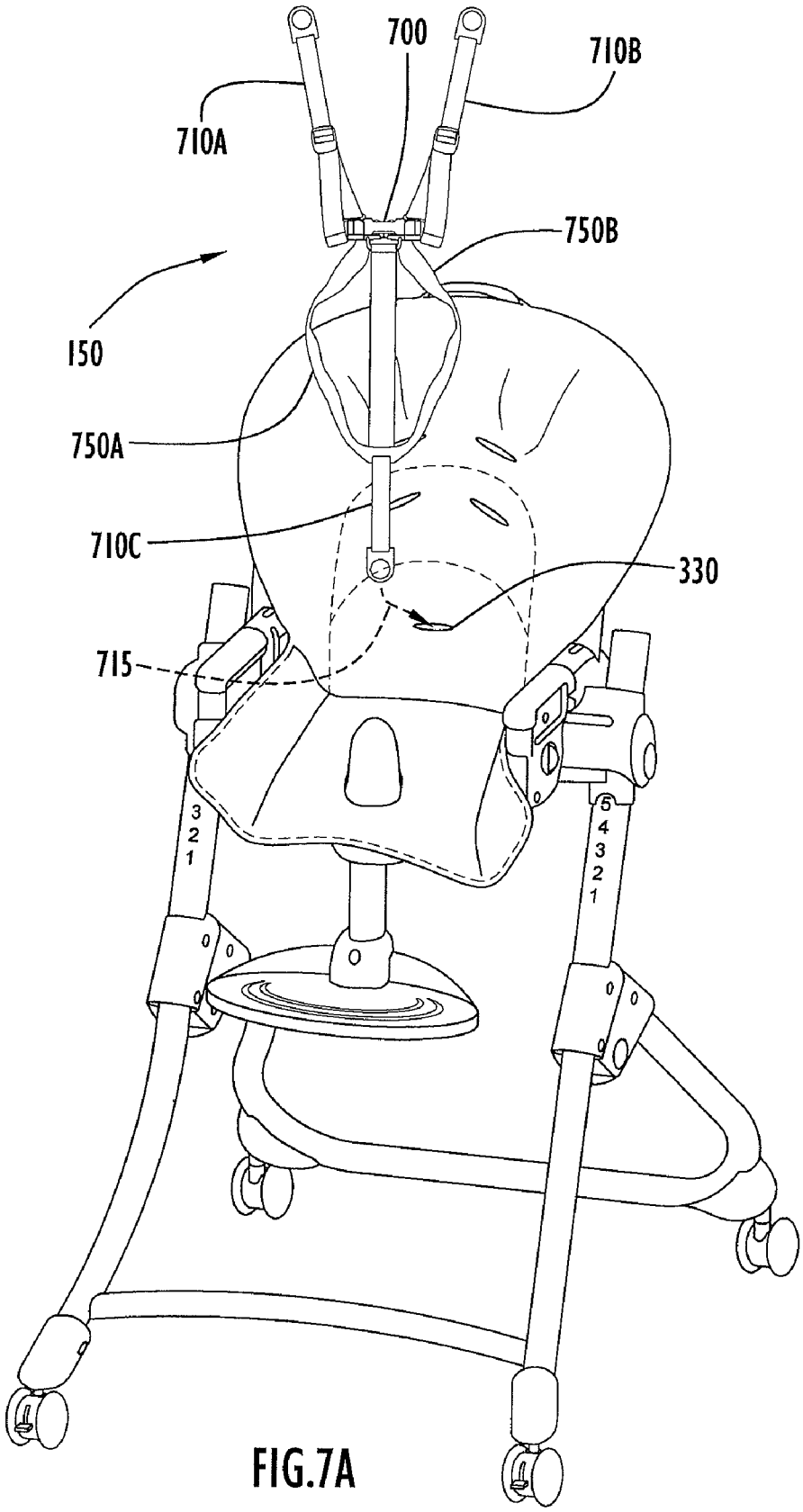
FIG. 7A illustrates a front perspective view of a restraint strap system including a crotch restraint strap positioned to be passed through the seating portion of a child support device in accordance with the present invention, the crotch restraint strap being passed through from the child receiving side to the outer side of the seating member.
Figure 7B:
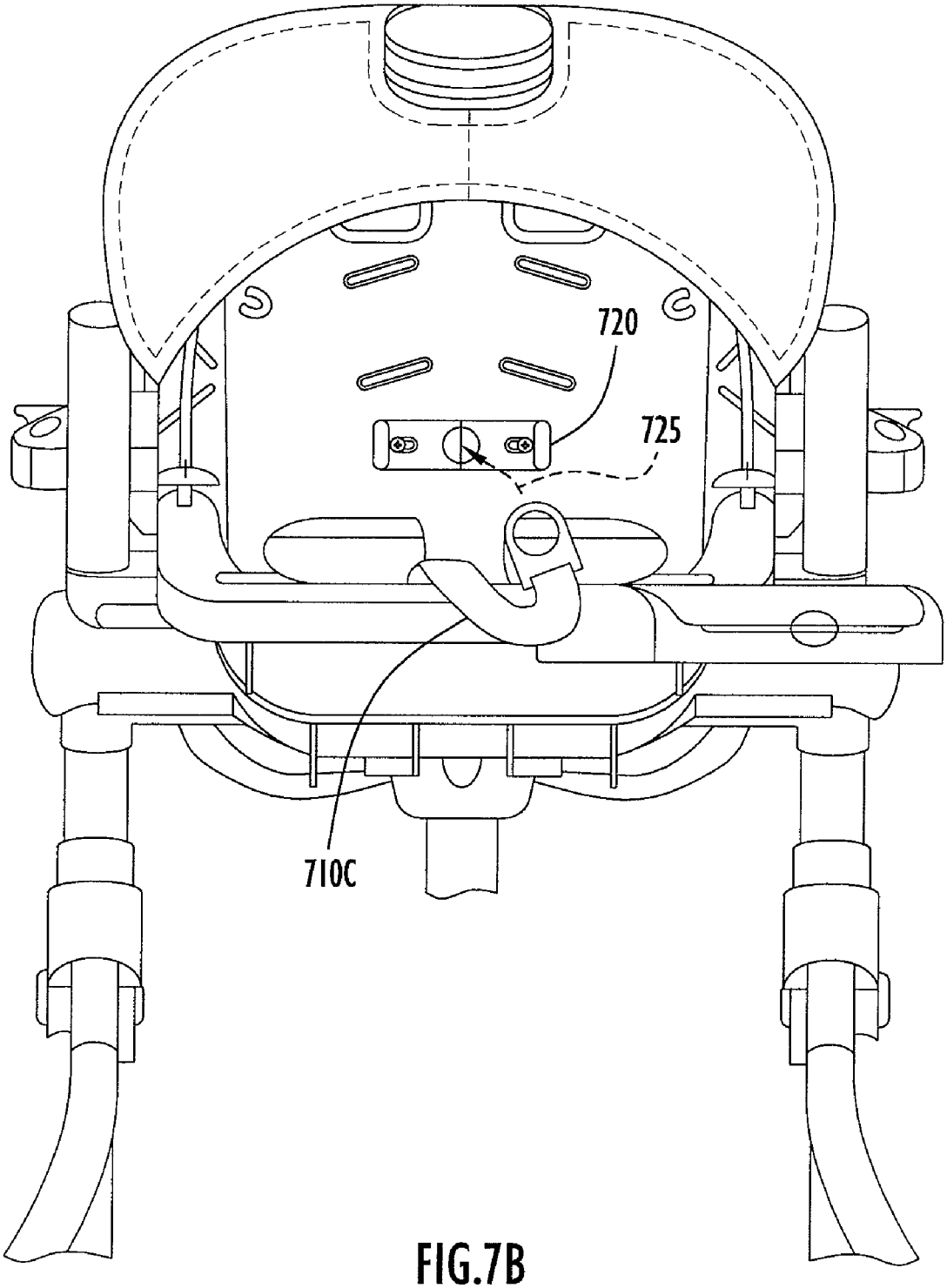
FIG. 7B illustrates a rear perspective view of the crotch restraint strap received through the seating portion (from the child receiving side to the outer side) of a child support device in accordance with the present invention.

FIG. 7A illustrates a front perspective view of the restraints 150 including a crotch restraint strap 710C, a left shoulder restraint strap 710A and a right shoulder restraint strap 710B. Also illustrated, are a left waist restraint strap 750A and right waist restraint strap 750B. The restraint straps 710A-C, 750A, and 750B are connected together at a central point by a center connector 700. FIG. 7 shows the crotch restraint strap 710C positioned to be passed through the seat member 110 of the present invention from the child receiving side to the outer side (as shown by arrow 715) through crotch restraint passage 330. FIG. 7B illustrates a rear perspective view of a restraint release mechanism 720 for securing ends of restraint straps 710A-C together on the outer side of the seat 110. Also illustrated is a crotch restraint strap 710C received through the seat 110 of the child support device 100 from the child receiving side, through the seat 110, to the outer side. FIG. 7B shows the end of the crotch restraint strap 710C positioned to be placed on the restraint release mechanism 720 (as shown by placement arrow 725).

Figure 8A:
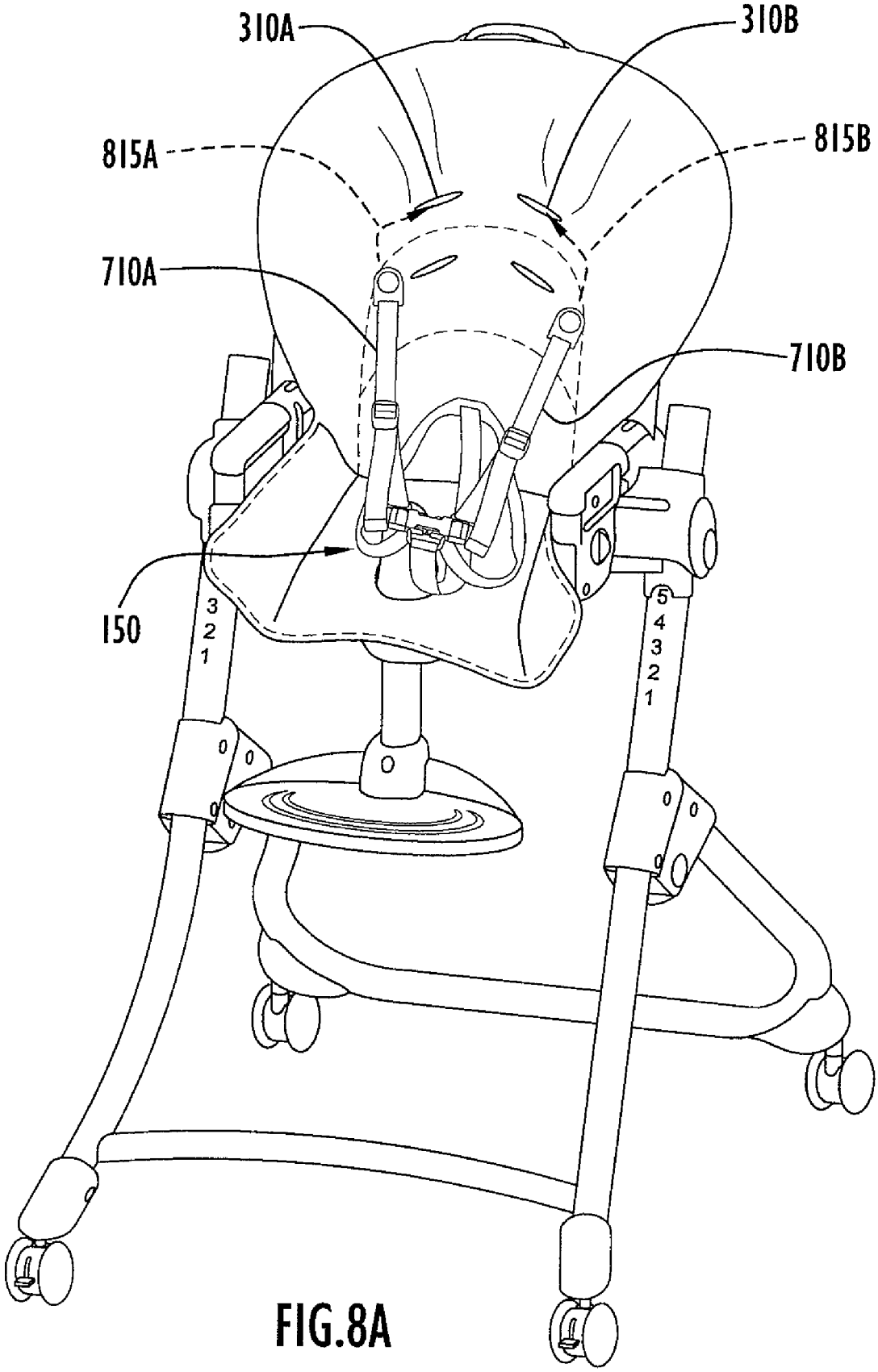
FIG. 8A illustrates a front perspective view of a restraint strap system including shoulder restraint straps positioned to be passed through the seat back portion of a child support device in accordance with present invention, the shoulder restraint straps being passed through from the child receiving side to the outer side.
Figure 8B:
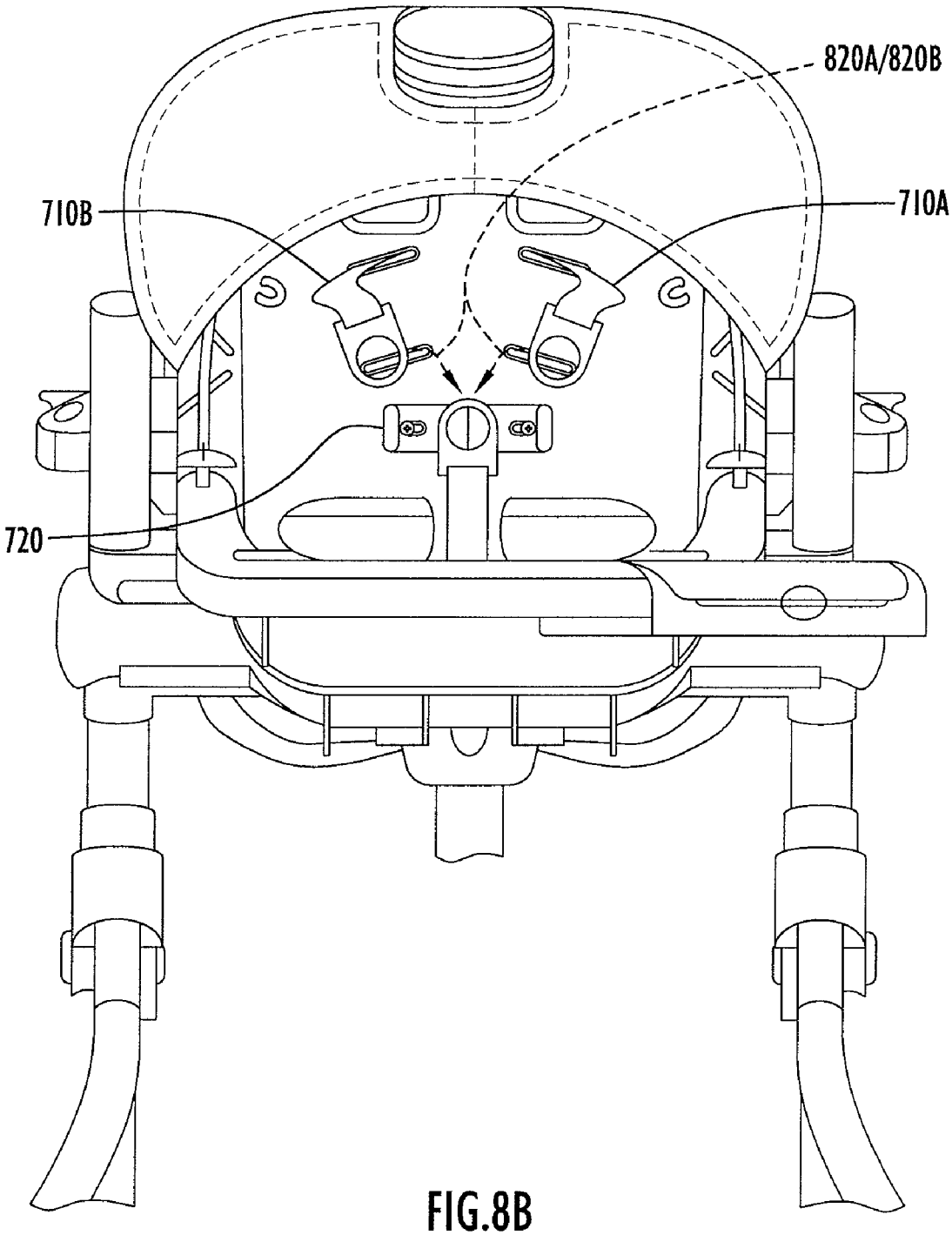
FIG. 8B illustrates a rear perspective view of the shoulder restraint straps received through the back rest portion (from the child receiving side to the outer side) of a child support device in accordance with the present invention.

FIG. 8A illustrates a front perspective view of left shoulder restraint strap 710A and right shoulder restraint strap 710B positioned to be passed through upper shoulder passages 310A and 310B respectively (as shown by arrows 815A and 815B). Both of left and right shoulder restraint straps 710A and 710B are then passed through upper shoulder passages 310A and 310B from the child receiving side of the seat 110 to the outer side. FIG. 8B illustrates a rear perspective view of the right and left shoulder restraint straps 710A and 710B received through the seat 110 of the child seat device 100 from the child receiving side to the outer side. FIG. 8B also shows the restraint release mechanism 720 for securing the ends of the restraint straps 710A-C. Also shown is the crotch restraint strap 710C positioned on the restraint release mechanism 720 and restraint straps 710A and 710B passed through to the outer side of the seat 110 and positioned to be connected to the restraint release mechanism 720 (as shown by placement arrows 820A and 820B).

Figure 9:
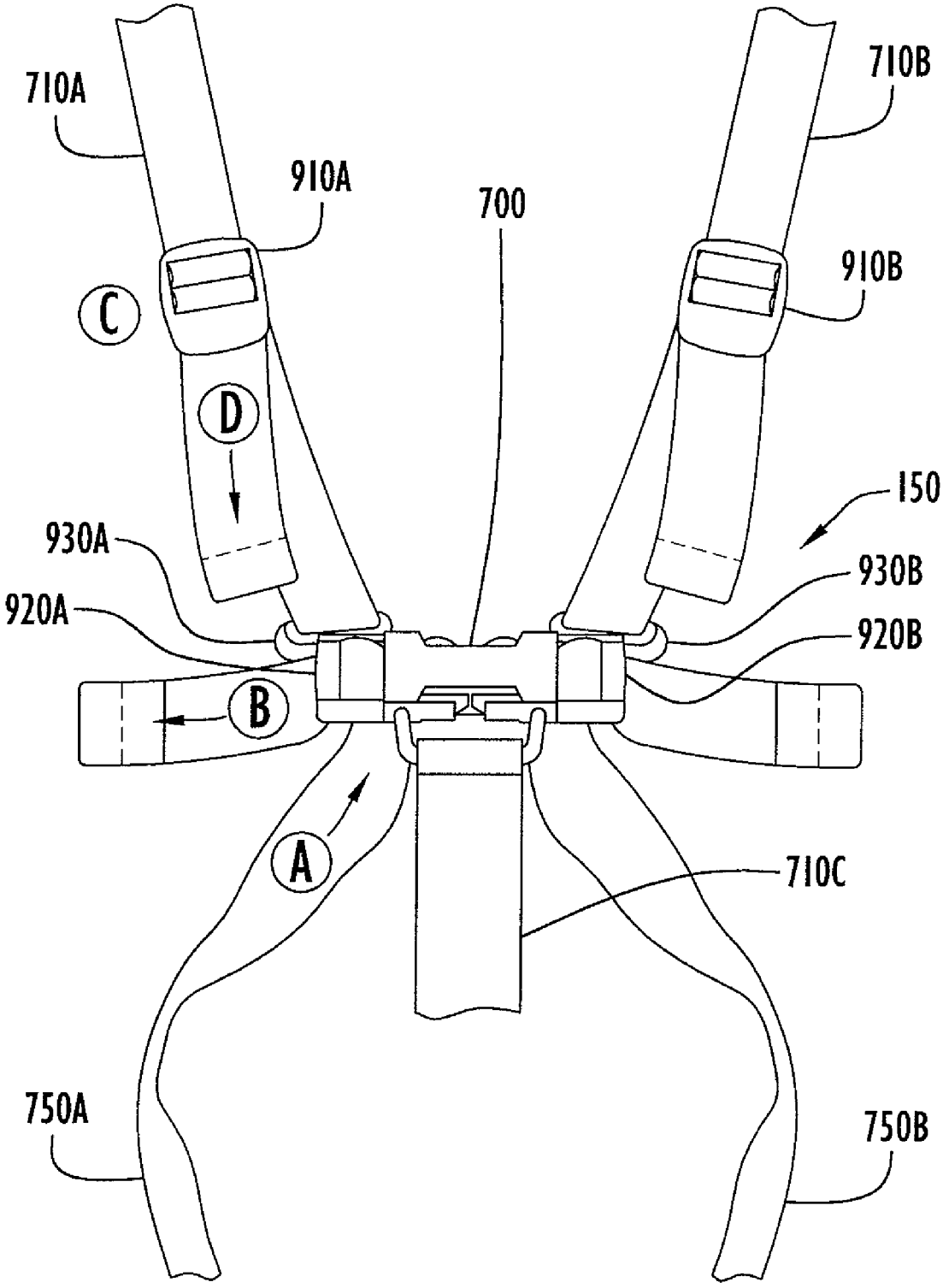
FIG. 9 illustrates a front view of a portion of the restraint strap system in accordance with the present invention, this portion of the restraint strap system being accessible on the child receiving side of the seat of a child support device in accordance with the present invention, the arrows that indicating how the restraint straps are adjusted (tightened or loosened).

FIG. 9 illustrates a view of the restraints 150 on the child receiving side of the seat 110 in accordance with the present invention showing how the restraint straps 710A, 710B, 750A, and 750B are adjusted. Each restraint strap 710A, 710B, 750A, and 750B has an adjustment buckle 910A, 910B, 920A, and 920B respectively, through which the length of portions of the restraint straps 710A, 710B, 750A, and 750B can be adjusted. Adjustments to the length of shoulder restraint strap 710A are accomplished through shoulder buckle 910A. For example, tightening adjustments are made by pulling restraint strap 710A in the manner indicated by arrow D. Similarly shoulder restraint strap 710B adjustments are done through shoulder buckle 910B. Adjustments to the length of waist restraint strap 750A are done through waist buckle 920A. For example, tightening adjustments are made by pulling restraint strap 750A in the manner indicated by arrows A and B. Similarly waist restraint strap 750B adjustments are done through waist buckle 920B. Finally, shoulder restraint strap connector 930A is connected to waist buckle 920A and shoulder restraint strap connector 930B is connected to waist buckle 920B. Connectors 930A and 930B can also be referred to as child restraint fasteners.

Figure 10:
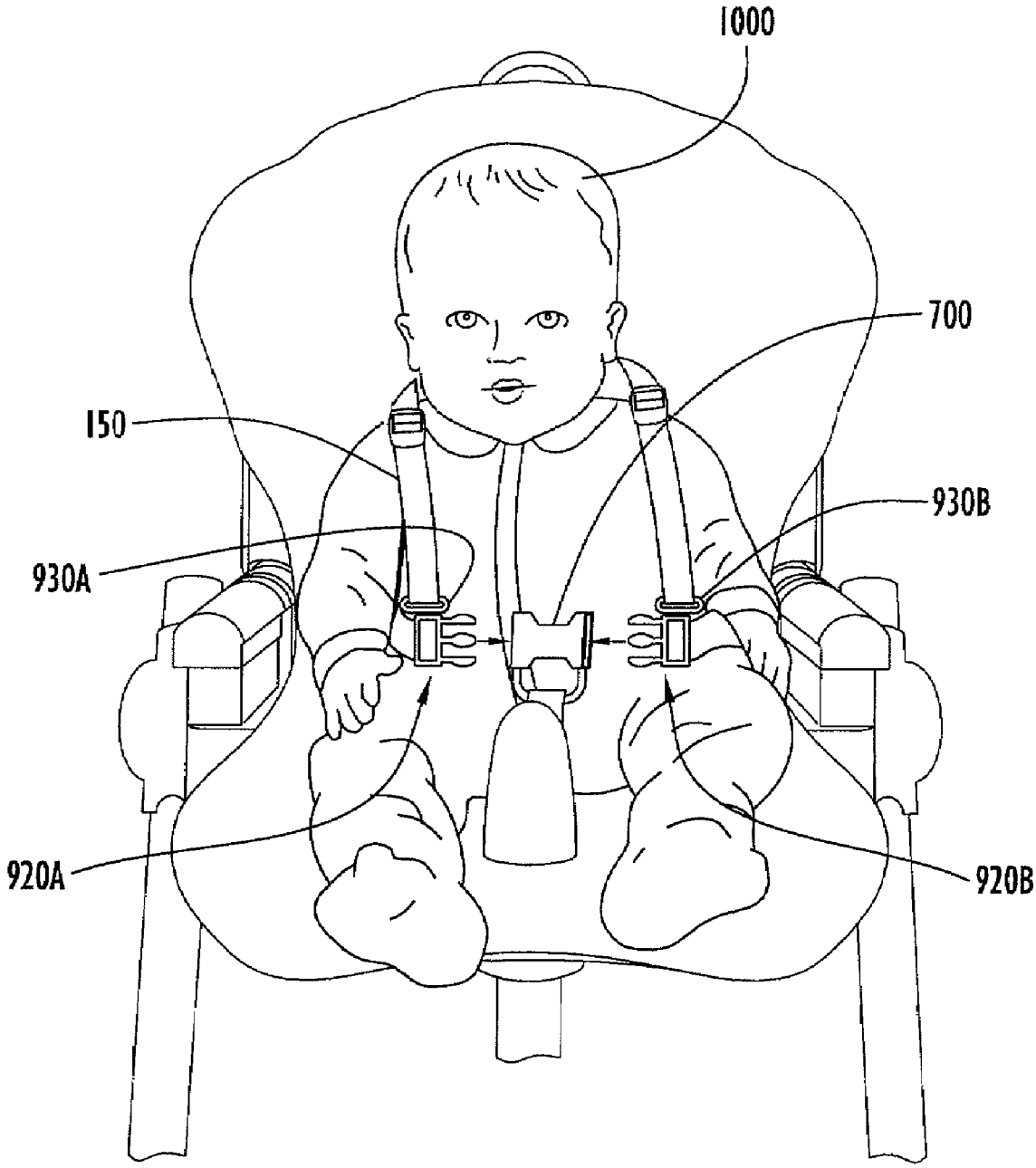
FIG. 10 illustrates a front view of the seat of a child support device in accordance with present invention occupied by a child being restrained in the seat by connecting the shoulder and crotch restraint strap ends together on the child receiving side of the child support device.

FIG. 10 illustrates a front view of the seat 110 occupied by a child 1000 being restrained in the restraints 150 by connecting the waist buckles 920A and 920B to the central connector 700. The central connector 700 shown in FIG. 10 is also the mechanism by which a parent releases a child from the restraints 150 while the restraints 150 are connected to the seat 110. The central connector 700 releasably receives waist buckles 920A and 920B in its sides. Buckles 920A and 920B can also be referred to as child release fasteners. To remove or restrain a child, the parent actuates the release between the central connector 700 and the waist buckles 920A and 920B. As shown, after actuation, the central connector 700 remains attached to the crotch restraint strap 710C (which now allows removal or placement of the child). When, the central connector 700 disengages from the waist buckles 920A and 920B (and the shoulder restraint strap connectors 930A and 930B) it also disengages from the waist and shoulder restraint straps 710A, 710B, 750A, and 750B. This disconnection enables a parent to removably place a child in the restraints 150 while the restraints 150 remain attached to the seat 110.

Figure 11:
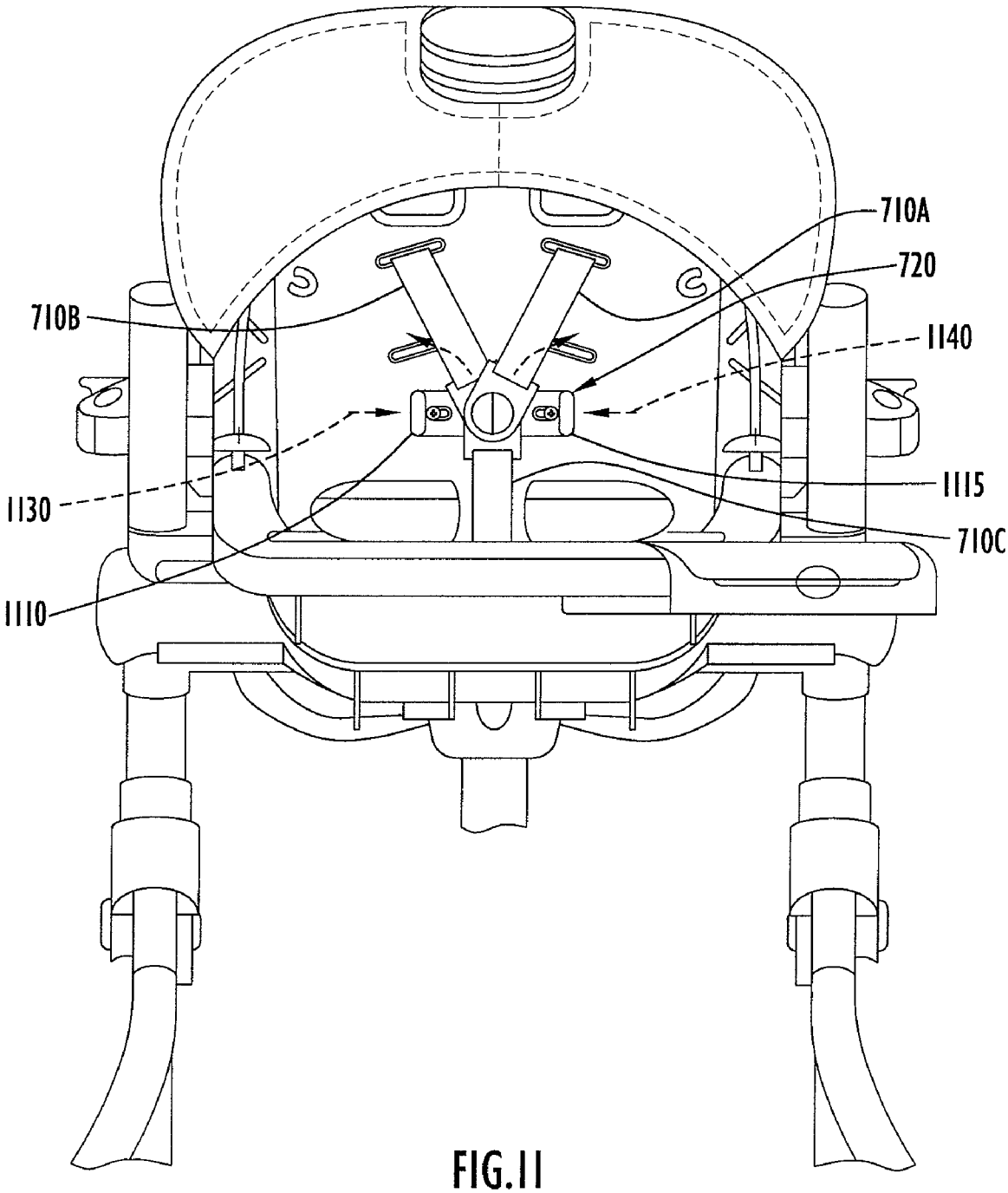
FIG. 11 illustrates a rear view of the ends of the restraint straps on the outer side of the seat of a child support device in accordance with the present invention showing the restraint straps secured by a restraint release mechanism and illustrating (via the arrows) an actuation motion of the restraint release mechanism to release the restraint straps.

FIG. 11 illustrates a rear view of the crotch restraint strap 710C and shoulder restraint straps 710A and 710B on the outer side of the seat 110 showing the restraints 150 secured on the outer side by a first slider 1110 and a second slider 1115 of the restraint release mechanism 720. FIG. 11 also shows the actuation motion necessary to either release or connect the restraint straps 710A-C to the restraint release mechanism 720 (as indicated by the arrows 1130 and 1140). Enlarged drawings showing the details of the restraint release mechanism 720 and the manner in which the restraint release mechanism 720 facilitates the releasing and restraining of the restraints 150 relative to the seat 110 will be discussed in detail below.

Figure 12:
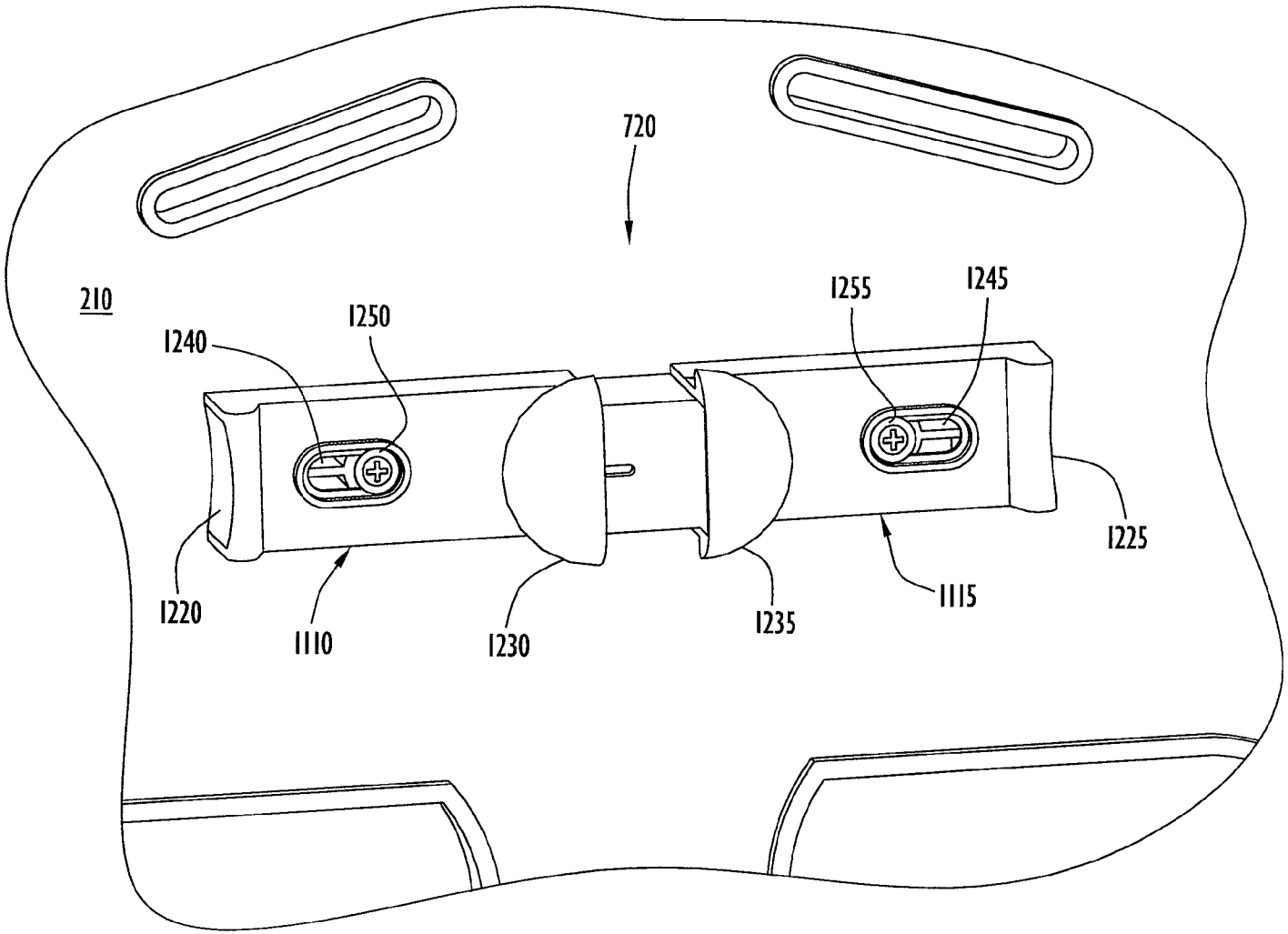
FIG. 12 illustrates an enlarged perspective view of the restraint release mechanism connected to the outer side of the back rest portion of a child support device in accordance with the present invention.

FIG. 12 illustrates a rear enlarged perspective view of the restraint release mechanism 720 connected to the outer side of the back rest 210 of the seat 110 of the present invention. The restraint release mechanism 720 includes a first slider 1110 and a second slider 1115. The first and second sliders 1110 and 1115 are elongated and are arranged to be aligned in the direction of elongation. On the inner end of the first slider 1110 is a first half post or coupling portion 1230 and on the inner end of the second slider 1115 is a second half post or coupling portion 1235. Each of the half posts or coupling portions can also be referred to as a fastener receiving portion. Each half post 1230 and 1235 projects outward (away from the seat 110) from its respective slider 1110 and 1115. The outer end of the first slider 1110 has a first compression seat 1220 and the outer end of the second slider 1115 has a second compression seat 1225. Each of the sliders 1110 and 1115 also has one of first and second rimmed apertures 1240 and 1245 there through for passing first and second securing fasteners 1250 and 1255 respectively. Fasteners 1250 and 1255 secure the restraint release mechanism 720 to the outer side of the back rest 210 of the seat 110.

Figure 13:
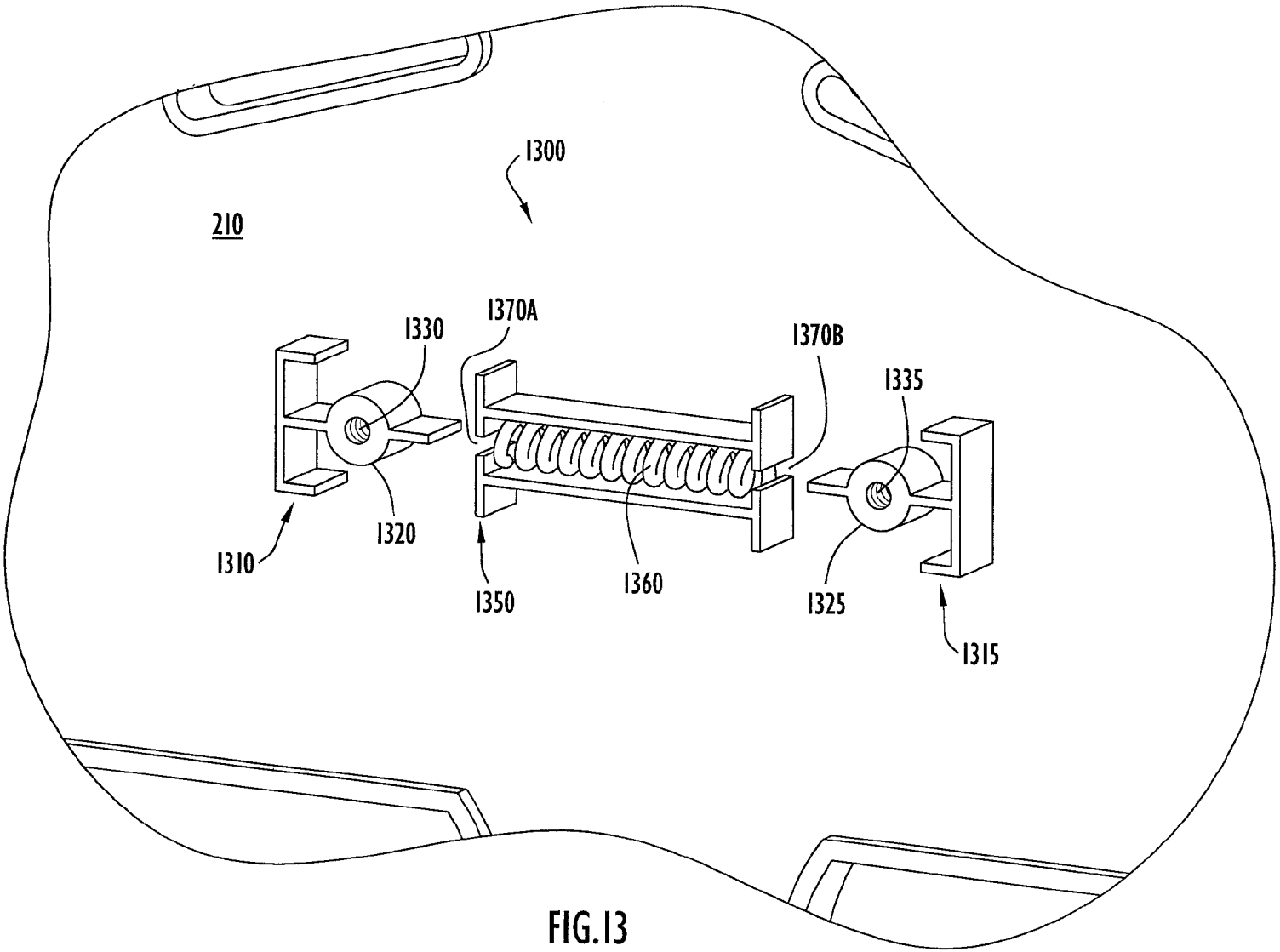
FIG. 13 illustrates a perspective view of the outer side of the back rest portion of a child support device in accordance with the present invention showing the connection members used to secure the restraint release mechanism to the back rest portion.

FIG. 13 illustrates a rear perspective view of the outer side of the back rest 210 showing the connection members 1300 used to secure the restraint release mechanism 720 to the outer side of the back rest 210 of the seat 110 of the present invention. The connection members 1300 extend from the outer side of the back rest 210 of the seat 110 and include a first attachment structure 1310 and a second attachment structure 1315 (for respectively connecting the first slider 1110 and second slider 1115 to the seat 110). The connection members 1300 also include a biasing member holder 1350. Each attachment structure includes one of fastener receivers 1320 and 1325 each respectively including one of receiver openings 1330 and 1335. To fasten the sliders 1110 and 1115 to the outer side of the seat 110, the fasteners 1250 and 1255 respectively pass through the rimmed apertures 1240 and 1245 and through the receiver openings 1330 and 1335 of the fastener receivers 1320 and 1325. Fasteners 1250 and 1255 are secured firmly to the fastener receivers 1320 and 1325, but the fasteners 1250 and 1255 are not tightened enough to prevent the sliders 1110 and 1115 from easily sliding relative to the fasteners 1250 and 1255. FIG. 13 also illustrates a biasing member holder 1350 for securing a biasing member 1360 (e.g., a spring). The biasing member holder 1350 includes a first spring access slot 1370A and an opposite side second spring access slot 1370B. In the illustrated embodiment, the connection members 1300 are integrally molded with the seat 110, although the connection members 1300 may be separately formed.

Figure 14:
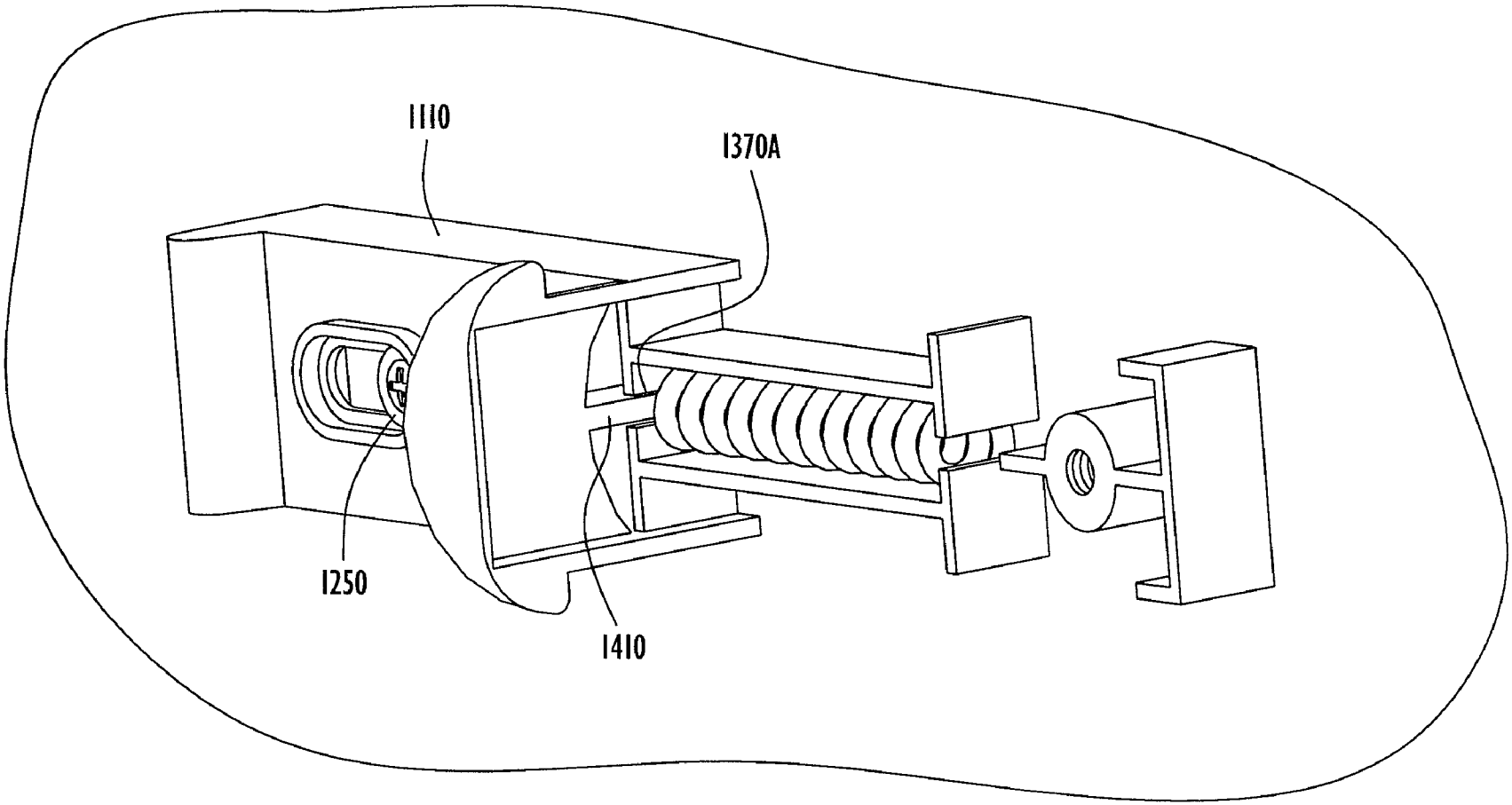
FIG. 14 illustrates a perspective view of a first slider of the restraint release mechanism of a child support device in accordance with the present invention shown attached to the connection members on the outer side of the back rest portion.

FIG. 14 illustrates a perspective view of the first slider 1110 of the restraint release mechanism 720 shown attached to the connection members 1300 of the seat 110 of the present invention by the fastener 1250. A first bias member contact 1410 of the first slider 1110 is aligned with the first spring access slot 1370A. A second bias member contact 1415 (shown in FIG. 16) of the second slider 1115 is aligned with the second spring access slot 1370B. As a result, when a force is applied to slide the first slider 1110 in an inward direction (as shown by arrows 1130 and 1140 in FIG. 11), the first bias member contact 1410 also moves inward through the first spring access slot 1370A to contact and compress the biasing member 1360. When the force is removed from the slider 1110, the stored energy in the biasing member 1360 forces the slider 1110 back to its original position.

Figure 15:
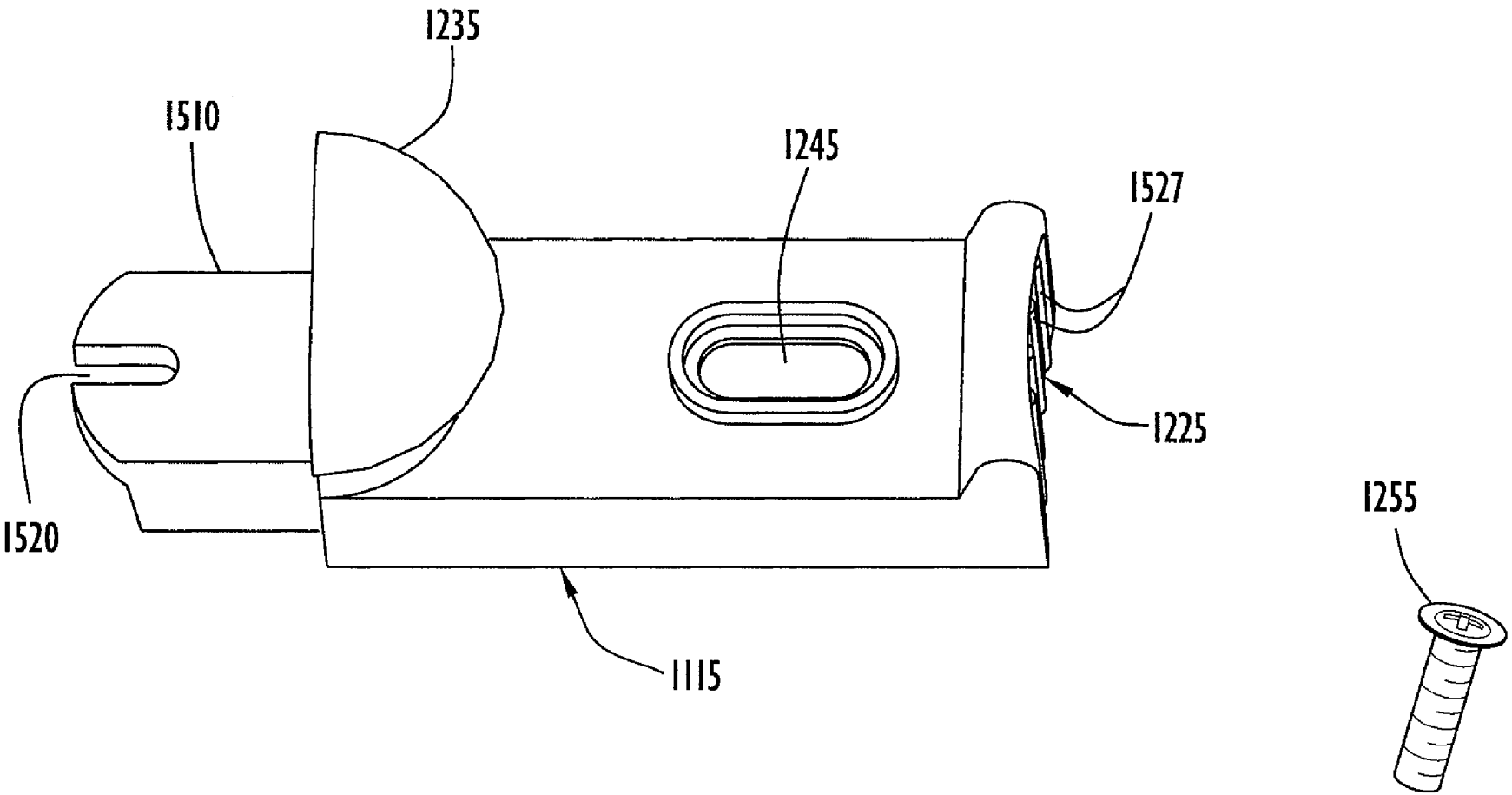
FIG. 15 illustrates an enlarged perspective view of a second slider of the restraint release mechanism of a child support device in accordance with the present invention and a fastener for securing the second slider to the connection members on the outer side of the back rest portion.

FIG. 15 illustrates an enlarged perspective view of the second slider 1115 of the restraint release mechanism 720 and a fastener 1255 for securing the second movable portion or slider 1115 to the outer side of the seat 110 of the present invention. The second slider 1115 has an alignment extension 1510 for extending in telescopic relation to a portion of the first slider 1110 to further ensure axial alignment. The alignment extension 1510 also includes a reception slot 1520 to accommodate the first bias member contact 1410 when an external force compresses the first and second sliders 1110 and 1115 axially together. FIG. 15 also illustrates grips 1527 on the compression seat 1225 of the second slider 1115 for ensuring firm finger contact during compression.

Figure 16:
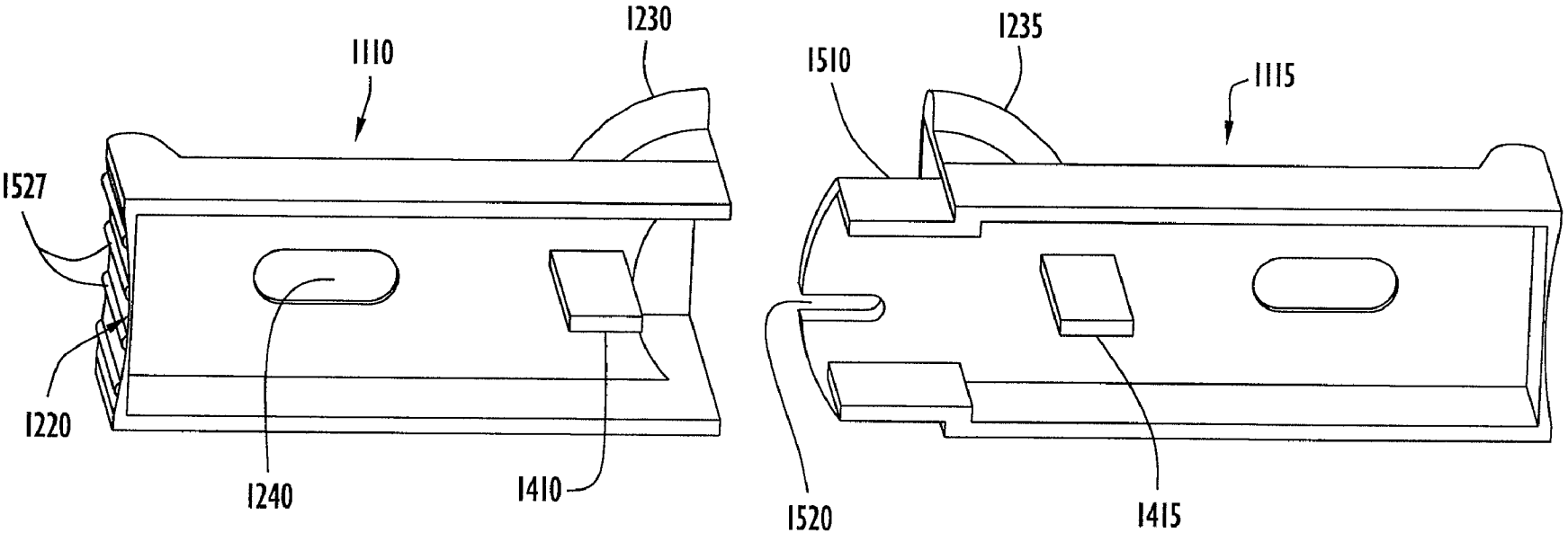
FIG. 16 illustrates a rear perspective view of the first and second sliders of the restraint release mechanism of a child support device in accordance with the present invention shown lying on their sides in a generally aligned arrangement and shown in a separated spatial relationship.

FIG. 16 illustrates a rear perspective view of the inner sides of first and second sliders 1110 and 1115 of the restraint release mechanism 720 of the present invention shown lying on their sides in a generally aligned and separated spatial relationship. The alignment extension or member 1510 of the second slider 1115 is shown positioned to be slid into the first slider 1110. The reception slot 1520 of the alignment member 1510 is also shown positioned to receive the first bias member contact 1410 of the first slider 1110. FIG. 16 also clearly illustrates how the first and second bias member contacts 1410 and 1415 align to respectively slide through first and second spring access slots 1370A and 1370B to compress the biasing member 1360 on both sides of the biasing member 1360.

Figure 17:
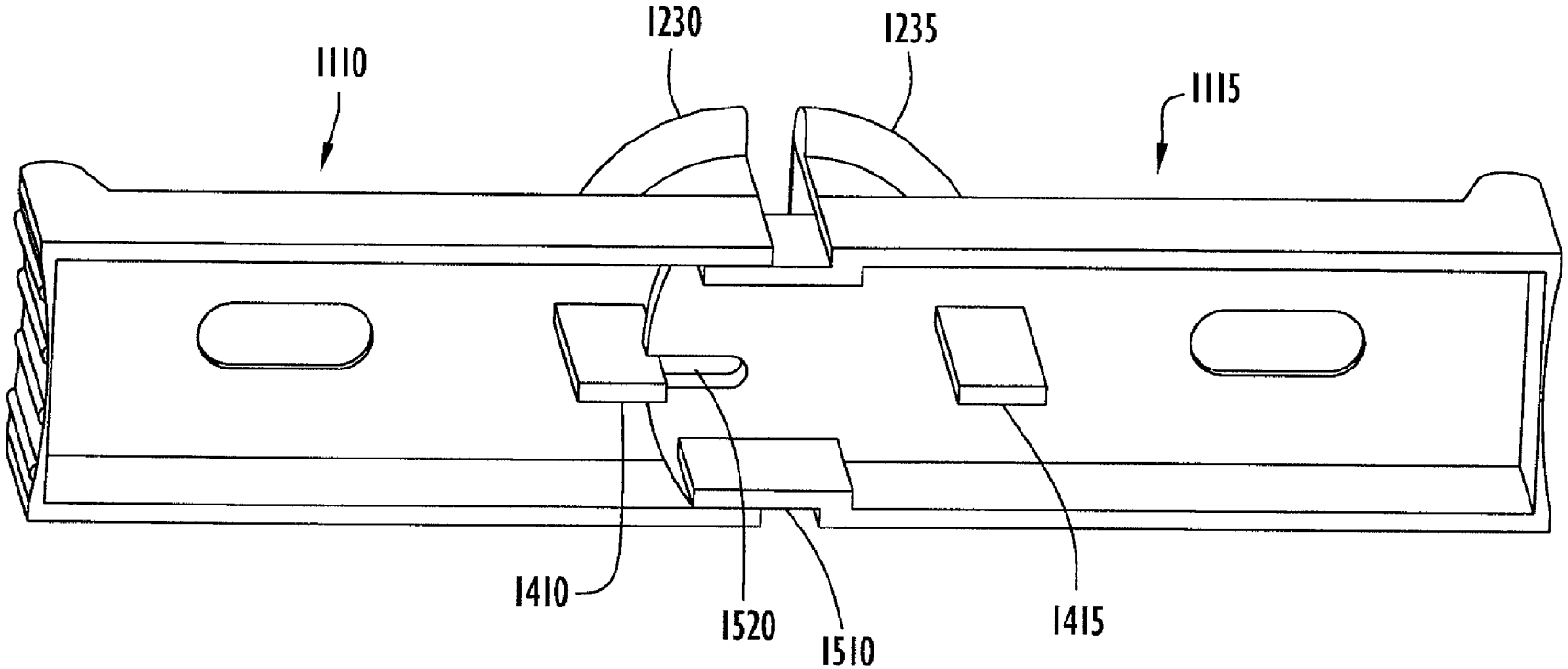
FIG. 17 illustrates a rear perspective view of the first and second sliders of the restraint release mechanism of a child support device in accordance with the present invention shown lying on their sides in a generally aligned arrangement and shown in a telescopic spatial relationship.

FIG. 17 illustrates an enlarged perspective view of the first and second sliders 1110 and 1115 of the restraint release mechanism 720 shown lying on their sides in a generally aligned and telescopic spatial relationship. More clearly shown is how the alignment member 1510 of the second slider 1115 is telescoped within the first slider 1110. Also illustrated is how the first and second bias member contacts 1410 and 1415 are moved closer together (as compared to FIG. 16) to compress the biasing member 1360 that would be located therebetween when the restraint release mechanism 720 is fully assembled on the connection members 1300. In addition, reception slot 1520 is shown ready to receive first bias member contact 1410.

Figure 18:
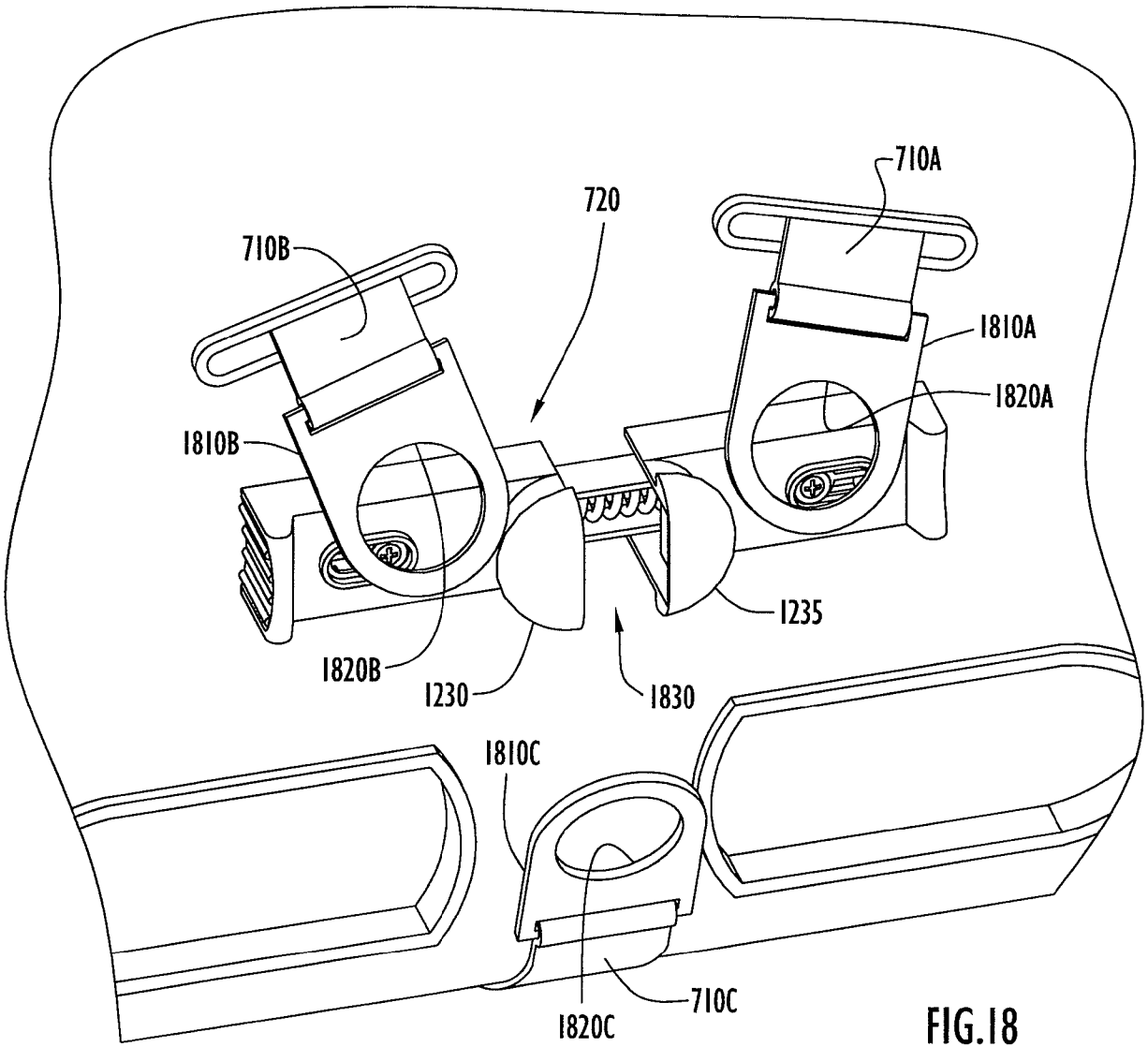
FIG. 18 illustrates an enlarged rear perspective view of ends of the restraint straps passed through the seat from the child receiving side of the seat to the outer side in accordance with the present invention and positioned to be connected to the restraint release mechanism.

FIG. 18 illustrates an enlarged rear perspective view of the restraint straps 710A-C of restraint 150 passed through the seat 110 from the child receiving side to the outer side and positioned to be connected to the restraint release mechanism 720. A number of fasteners 1810A-C are connected to the ends of restraint straps 710A-C. Each fastener includes an aperture 1820A-C therein. Each of the fasteners 1810A-C can be referred to as a restraint release fastener. In addition, restraint release mechanism 720 stands at rest with a gap 1830 between the first half post 1230 and the second half post 1235. In this position, the gap 1830 prevents the apertures 1820A-C (of fasteners 1810A-C) from being placed over the first half post 1230 and the second half post 1235 (i.e., they are too far apart to be placed in the apertures 1820A-C).

Figure 19:
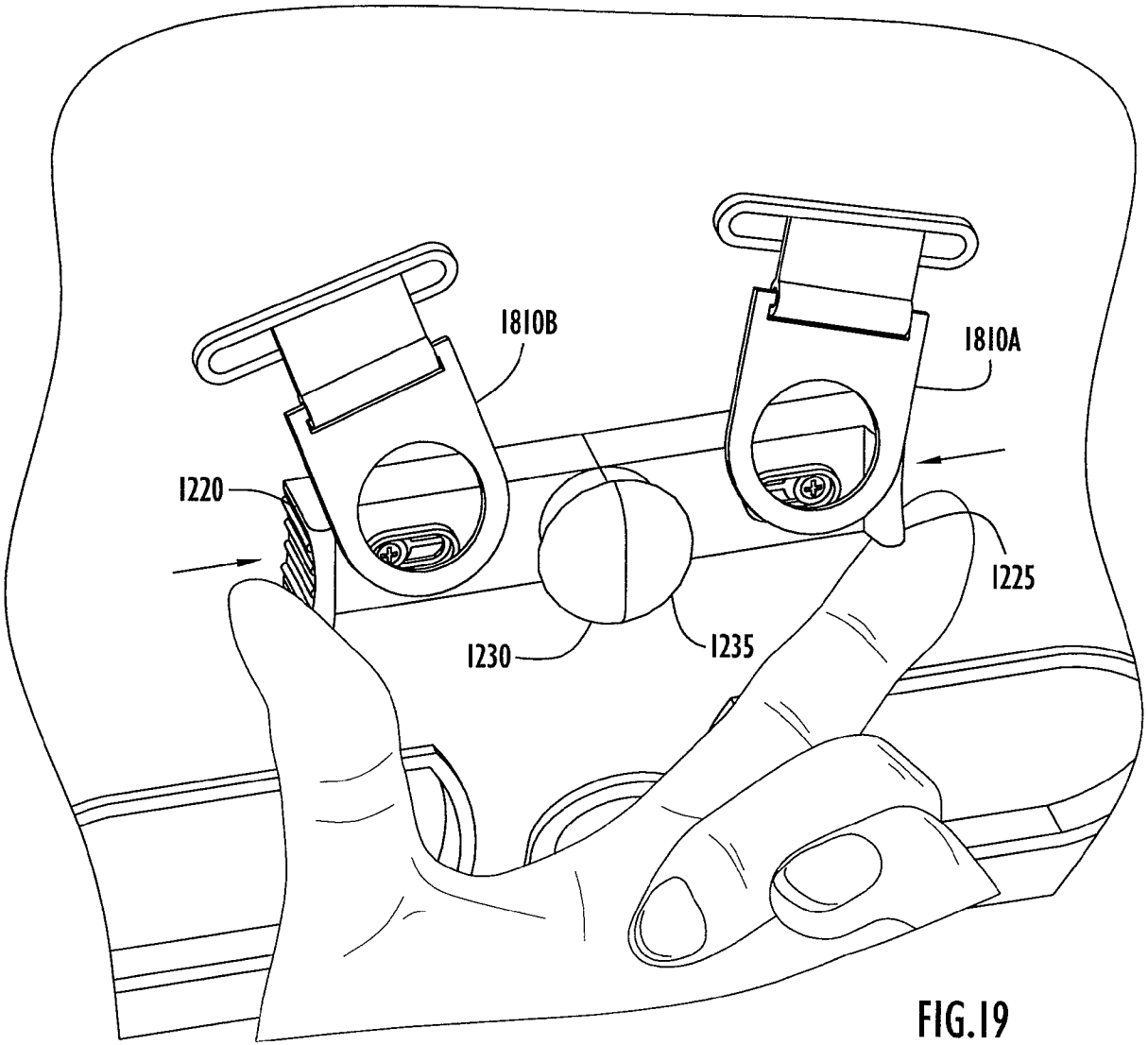
FIG. 19 illustrates an enlarged rear perspective view of the shoulder restraint straps passed through from the child receiving side of the seat to the outer side in accordance with the present invention and the restraint release mechanism being compressed in preparation for receiving the restraint strap ends.

FIG. 19 illustrates an enlarged perspective rear view of the shoulder restraint straps 710A and 710B of the restraints 150 passed through the seat 110 from the child receiving side to the outer side. As illustrated, the compression seats 1220 and 1225 of the restraint release mechanism 720 are being compressed in preparation for receiving the restraints. Compression of the restraint release mechanism 720 eliminates the gap 1830 between the first half post 1230 and the second half post 1235 and arranges the first half post 1230 and the second half post 1235 in a compact adjacent manner in preparation for receiving the fasteners 1810A and 1810B.

Figure 20:
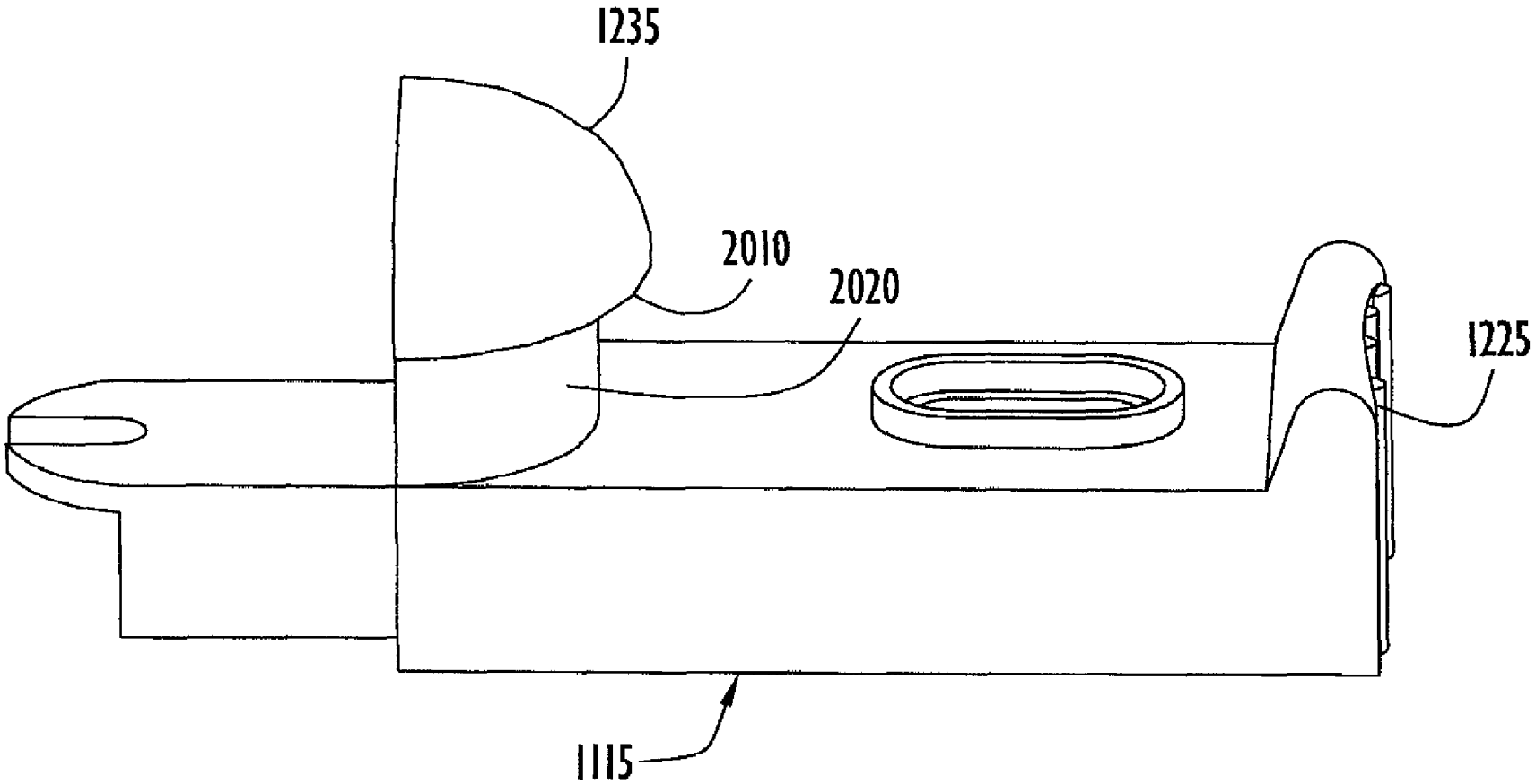
FIG. 20 illustrates an enlarged side perspective view of a trapping neck and a lip of the second slider of the restraint release mechanism in accordance with the present invention.

FIG. 20 illustrates an enlarged side perspective view of a trapping lip 2010 on the second half post 1235 of the second slider 1115 of the restraint release mechanism 720. First and second half posts 1230 and 1235 also each have a neck 2020 and 2025 (not shown in FIG. 20) on which fasteners 1810A-C are received while being trapped by the trapping lip 2010. The first half post 1230 of the first slider 1110 also has a similar opposite trapping lip 2005 (not shown in FIG. 20). The function of the trapping lips 2005 and 2010 will be explained in more detail below with respect to FIG. 23.

Figure 21:
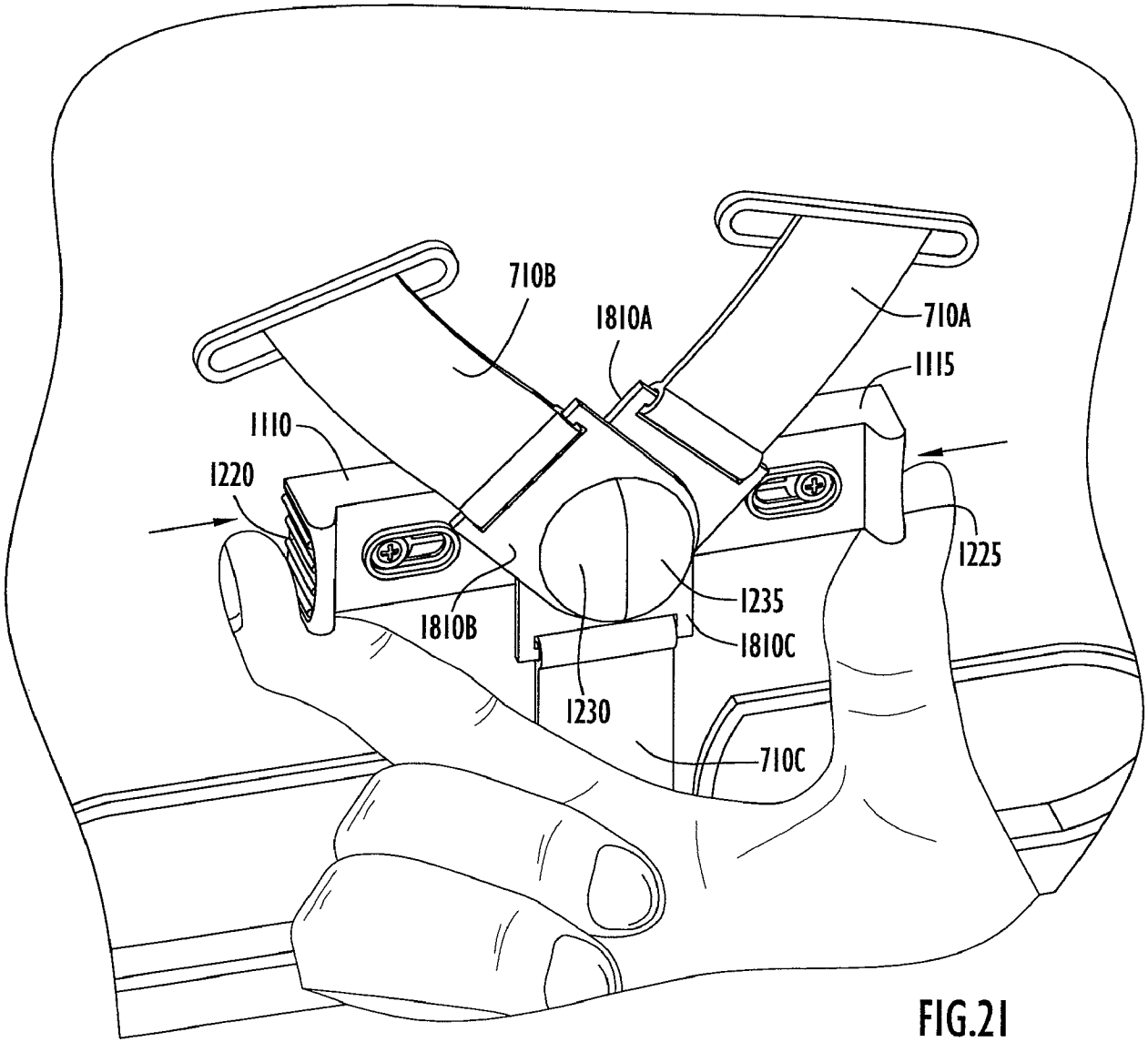
FIG. 21 illustrates an enlarged rear perspective view showing the first and second sliders of the restraint release mechanism in accordance with the present invention, the sliders being compressed together and the restraint strap ends positioned on the restraint release mechanism to be secured by the restraint release mechanism.

FIG. 21 illustrates an enlarged rear perspective view showing the first and second sliders 1110 and 1115 of the restraint release mechanism 720 being held together by compressing the compression seats 1220 and 1225 of the first and second sliders 1110 and 1115. The compressed adjacent arrangement of the first and second half posts 1230 and 1235 allow the fasteners 1810A-C of the restraints 150 to be positioned over the first and second half posts 1230 and 1235 of the restraint release mechanism 720.

Figure 22:
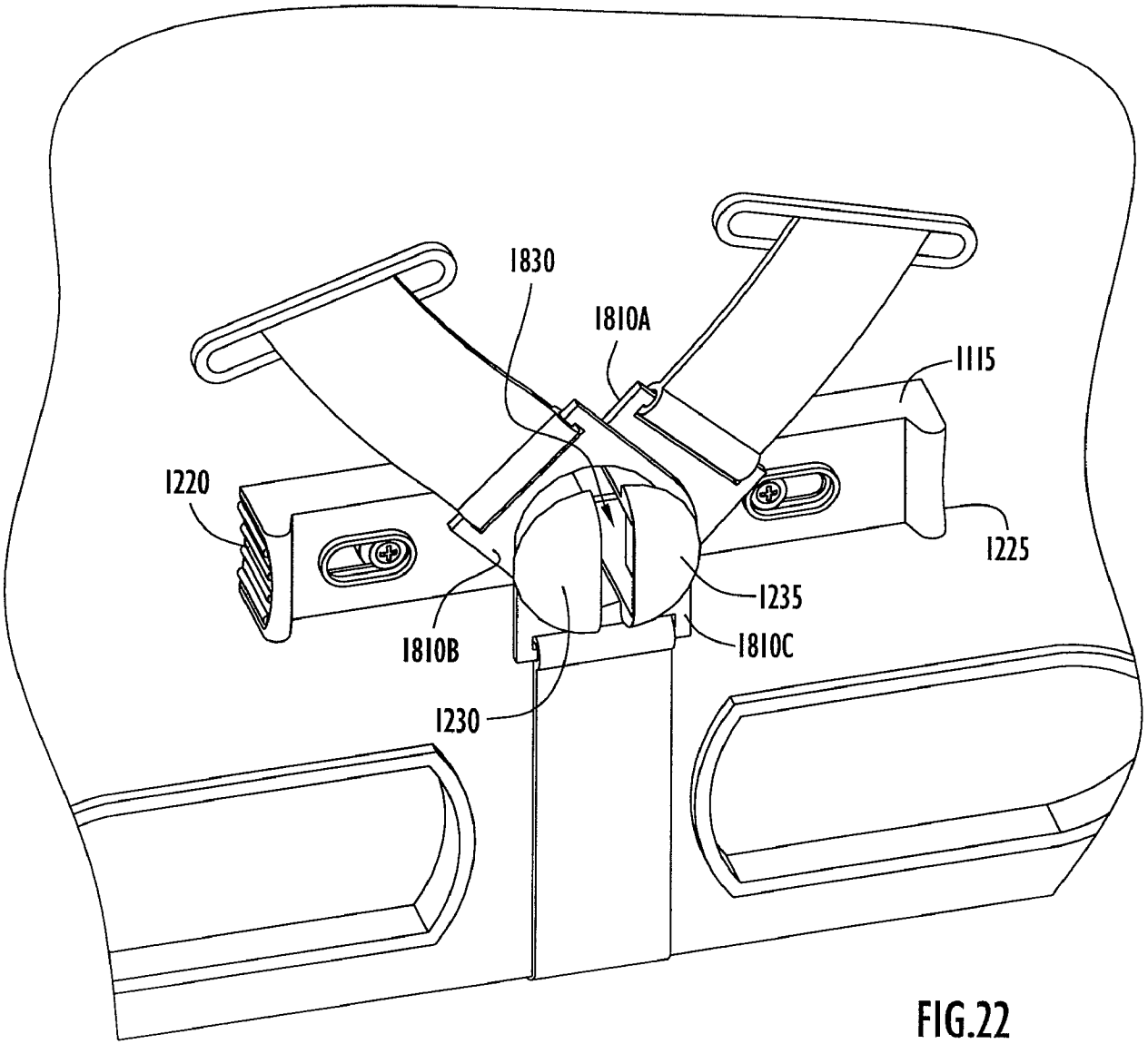
FIG. 22 illustrates an enlarged rear perspective view of the first and second sliders of the restraint release mechanism in accordance with the present invention released to secure the restraint straps on the outer side of the seat.

FIG. 22 illustrates an enlarged rear perspective view of the first and second sliders 1110 and 1115 of the restraint release mechanism 720 released to secure the restraints 150 on the outer side of the seat 110 of the present invention. When the compressive force is released, the biasing member 1360 forces the first and second bias member contacts 1410 and 1415 apart, and thus, forces the first and second half posts 1230 and 1235 apart. The fasteners 1810A-C that have been placed on the first and second half posts 1230 and 1235 become trapped on the necks 2020 and 2025 of the first and second half posts 1230 and 1235 and are held in place by the trapping lips 2005 and 2010. When the first and second half posts 1230 and 1235 are released and the fasteners 1810A-C are properly trapped on necks 2020 and 2025 under the trapping lips 2005 and 2010, the first and second half posts 1230 and 1235 separate again to reform gap 1830. As shown in FIG. 22, the distance between compression seats 1220 and 1225 can be chosen to be greater than a child's fingers can span (to prevent a young sibling from accidentally releasing the restraints 150). Furthermore, the restraint release mechanism 720 can be designed to prevent fasteners 1810A-C from being removed if only one of the sliders 1110 and 1115 is compressed.

Figure 23:
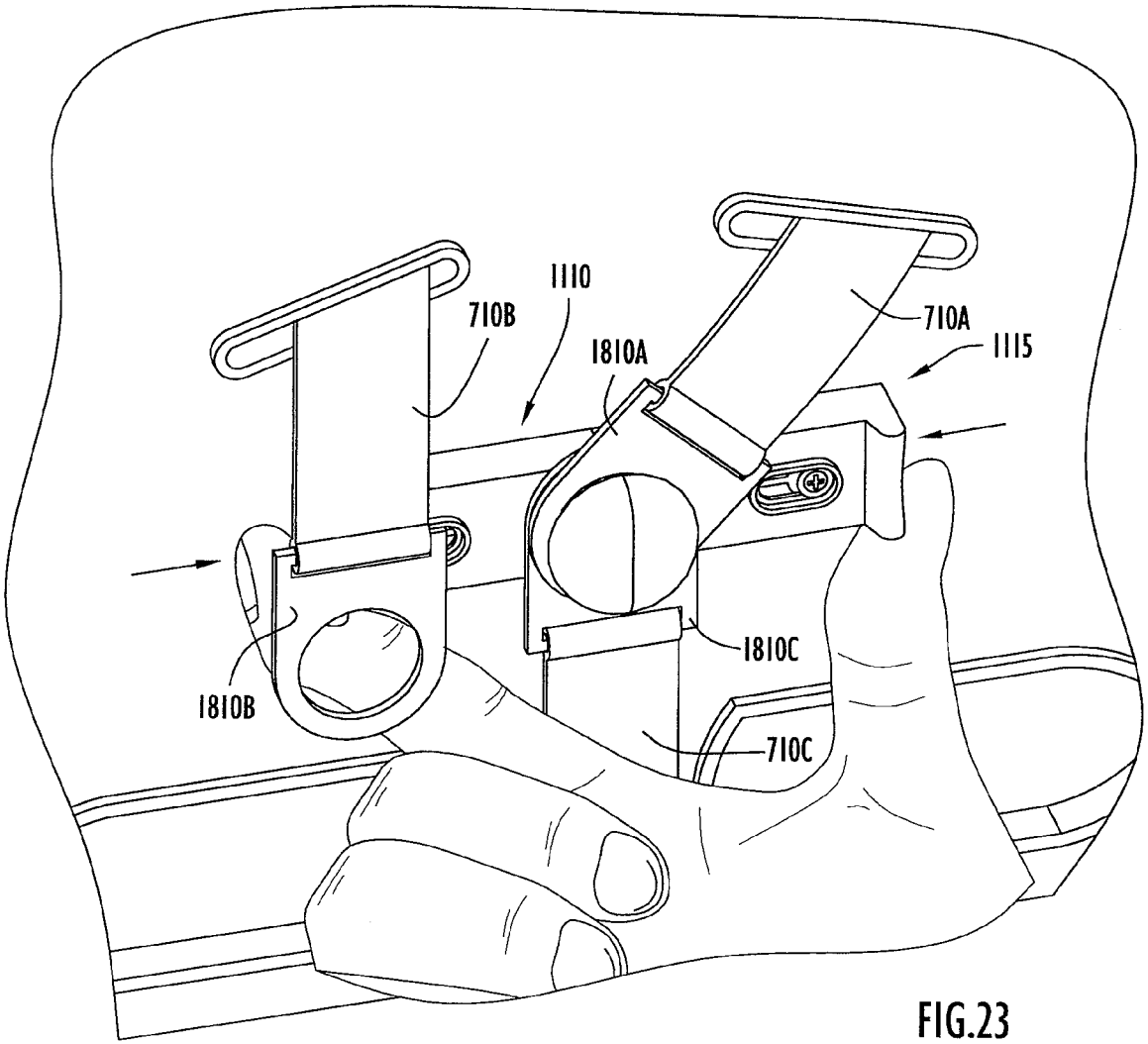
FIG. 23 illustrates an enlarged rear perspective view of the first and second sliders of the restraint release mechanism in accordance with the present invention compressed to allow a restraint straps to be disconnected from the restraint release mechanism and showing a released shoulder restraint strap.

FIG. 23 illustrates an enlarged rear perspective view of the first and second sliders 1110 and 1115 of the restraint release mechanism 720 compressed to allow the fasteners 1810A-C to be removed from the restraint release mechanism 720 and showing fastener 1810B released from the restraint release mechanism 720. After the first and second sliders 1110 and 1115 are compressed, all of the fasteners 1810A-C can be removed from the restraint release mechanism 720. The restraints 150 can then be removed from the seat 110 by pulling the restraint straps 710A-C out of the seat passages 310A, 310B and 330 from the outer side to the child receiving side and completely removing the restraints 150 from the seat 110 to be cleaned.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration.

What is claimed is:

1. A child seat comprising:

a seat including a child receiving side and an outer side opposite said child receiving side, said seat including a seating portion and a back rest portion, said seat also including passages through said seat for receiving child restraint straps, said passages passing from said child receiving side to said outer side;

a restraint including at least two child restraint straps, each of said child restraint straps including a restraint release fastener disposed on at least a first end of said child restraint straps; and a restraint release mechanism for releasably securing said restraint by securing at least two of said restraint release fasteners of said child restraint straps, said restraint release mechanism being coupled to said outer side of said seat and including a slider for actuating said restraint release mechanism to release all of said restraint release fasteners and child restraint straps with a single actuation of said slider, and wherein said slider includes a compression seat and a biasing member and wherein said compression seat is pressed to move said slider against a force of said biasing member to position said slider to receive or release said restraint release fasteners, and wherein said slider also includes a fastener receiving portion for removeably and securely receiving said restraint release fasteners of said child restraint straps.

2. The child seat of claim 1, wherein said child restraint straps of said restraint include child release fasteners disposed on second ends of said child restraint straps opposite to said restraint release fasteners to allow said second ends of said child restraint straps to be releasably fastened together on said child receiving side of said seat.

3. The child seat of claim 1, wherein when said fastener receiving portion receives said restraint release fasteners, release of said slider allows said biasing member to force said slider to secure said restraint release fasteners of said child restraint straps on said fastener receiving portion, and compression of said slider against the force of said biasing member allows said restraint release fasteners of said child restraint straps to be removed from said fastener receiving portion.

4. The child seat of claim 3, wherein said slider of said restraint release mechanism is composed of at least two sliders separated by the force of said biasing member, and wherein said fastener receiving portion of said slider is composed of a fastener receiving portion on each of said sliders.

5. The child seat of claim 4, wherein the fastener receiving portion of one slider is disposed proximate to the fastener receiving portion of another slider when the sliders are moved toward each other, each of the restraint release fasteners includes an aperture, and the fastener receiving portions of the sliders are disposed in the apertures when the restraint release fasteners are coupled to the restraint release mechanism.

6. The child seat of claim 1, further comprising a support frame connected to said seat for supporting said seat above a supporting surface.

7. The child seat of claim 6, wherein said seating portion includes at least a first slide lock connector, said support frame having at least a first post slidably securable in said first slide lock connector, said first slide lock connector securable in a selected position along said first post to adjust a height of said seating portion relative to the supporting surface.

8. The child seat of claim 1, wherein said back rest portion is pivotally connected to said seating portion.

9. The child seat of claim 1, further comprising a crotch post extending upwardly from said seating portion on said child receiving side.

10. The child seat of claim 1, further comprising a foot rest connected to and extending downwardly from said outer side of said seat.

11. The child seat of claim 1, wherein said restraint release mechanism further comprises a second slider having a second fastener receiving portion, said fastener receiving portions of said sliders biased away from each other via said biasing member and movable toward each other against said force of said biasing member, said restraint release fasteners receivable on said fastener receiving portions when said sliders are moved toward each other and securable thereon when said sliders are biased away from each other via said biasing member.

12. The child seat of claim 11, wherein each of said restraint release fasteners includes an aperture receivable and securable on said fastener receiving portions.

13. The child seat of claim 11, wherein each of said fastener receiving portions is configured as a half post having a neck extending outwardly from a corresponding one of said sliders and a trapping lip extending outwardly from a distal end of said neck.

14. The child seat of claim 11, wherein said sliders are axially aligned.

* * * * *